US009885146B2

(12) United States Patent
Fugetsu et al.

(10) Patent No.: US 9,885,146 B2
(45) Date of Patent: Feb. 6, 2018

(54) ELECTRO-CONDUCTIVE FIBERS WITH CARBON NANOTUBES ADHERED THERETO, ELECTRO-CONDUCTIVE YARN, FIBERS STRUCTURAL OBJECT, AND PRODUCTION PROCESSES THEREOF

(75) Inventors: Bunshi Fugetsu, Sapporo (JP); Eiji Akiba, Osaka (JP); Masaaki Hachiya, Ichinomiya (JP)

(73) Assignees: National University Corporation Hokkaido University, Sapporo-shi (JP); Mitsui & Co., Ltd., Tokyo (JP); Kuraray Co., Ltd., Kurashiki-shi (JP); Chakyu Dyeing Co., Ltd., Ichinomiywa-shi (JP)

( * ) Notice: Subject to any disclaimer, the term of this patent is extended or adjusted under 35 U.S.C. 154(b) by 459 days.

(21) Appl. No.: 13/060,596

(22) PCT Filed: Aug. 31, 2009

(86) PCT No.: PCT/JP2009/065159

§ 371 (c)(1),
(2), (4) Date: Feb. 24, 2011

(87) PCT Pub. No.: WO2010/026937

PCT Pub. Date: Mar. 11, 2010

(65) Prior Publication Data

US 2011/0151254 A1 Jun. 23, 2011

(30) Foreign Application Priority Data

Sep. 2, 2008 (JP) ..... 2008-224821

(51) Int. Cl.

| | |
|---|---|
| ***D06M 11/74*** | (2006.01) |
| ***D06M 10/02*** | (2006.01) |
| ***D06M 10/06*** | (2006.01) |

(52) U.S. Cl.
CPC ..... *D06M 11/74* (2013.01); *D06M 10/02* (2013.01); *D06M 10/06* (2013.01); *D06M 2200/00* (2013.01); *Y10T 428/292* (2015.01)

(58) Field of Classification Search
CPC ..... C01B 31/0273; C01B 31/0213; C01B 2202/02; C01B 2202/06; C01B 2202/22;
(Continued)

(56) References Cited

U.S. PATENT DOCUMENTS 5,853,877 A * 12/1998 Shibuta ..... 428/357
7,875,802 B2 * 1/2011 Tsotsis ..... H01B 1/24 174/126.1

(Continued)

FOREIGN PATENT DOCUMENTS

EP 1 559 815 A2 8/2005
EP 1 559 815 A3 8/2005

(Continued)

OTHER PUBLICATIONS

Wacker Chemie AG Article, Fiber Lubricants,http://www.wacker.com/cms/en/products-markets/textile/fibremanufacturing/fibreprocess_aid/fibre_lube.jsp?country=US&language=en,copyright 2013.*

(Continued)

*Primary Examiner* — Scott R Walshon
(74) *Attorney, Agent, or Firm* — Oblon, McClelland, Maier & Neustadt, L.L.P.

(57) ABSTRACT

Electro-conductive fibers comprise synthetic fibers and an electro-conductive layer containing carbon nanotubes and covering a surface of the synthetic fibers, and the coverage of the electro-conductive layer relative to the whole surface of the synthetic fibers is not less than 60% (particularly not less than 90%). The electric resistance value of the electro-conductive fibers ranges from $1\times10^{-2}$ to $1\times10^{10}$ Ω/cm, and (Continued)

the standard deviation of the logarithm of the electric resistance value is less than 1.0. The thickness of the electro-conductive layer ranges from 0.1 to 5 μm, and the ratio of the carbon nanotubes may be 0.1 to 50 parts by mass relative to 100 parts by mass of the synthetic fibers. The electro-conductive layer may further contain a binder. The electro-conductive fibers may be produced by immersing the synthetic fibers in a dispersion with vibrating the synthetic fibers to form the electro-conductive layer adhered to the surface of the synthetic fibers. The electro-conductive fibers have the carbon nanotubes homogeneously and firmly adhered to an almost whole of a surface thereof and have an electro-conductivity and a softness.

26 Claims, 1 Drawing Sheet

(58) Field of Classification Search

CPC ..... C01B 2202/36; C01B 2202/34; C01B 31/0253; C01B 31/02; C01B 31/00; C01B 2202/28; C02F 1/283; B82Y 10/00; H01B 1/127; H01B 1/24; H01B 1/20; H01B 1/22; H01L 51/444; H01L 51/0037; H01L 51/0049; H01L 51/5206; H01L 51/0048; Y02E 10/549; D04H 1/64; D04H 1/642; D04H 1/641; D06M 11/47; D06M 11/65; D06M 11/73–11/74; D06M 11/83; D06M 15/227; D06M 15/233; D06M 15/248; D06M 15/263; D06M 15/327; D06M 15/333; D06M 15/3562; D06M 15/41; D06M 15/423; D06M 15/507; D06M 15/55; D06M 15/564; D06M 15/693; D06M 2200/00; D06M 23/08; D06N 3/0052; D06N 3/0063; D06N 3/10; G03G 15/0233; G03G 21/0035; D01D 5/253; Y10T 42/292

USPC ..... 428/367, 375, 357, 408, 34.1, 911, 220, 428/299.1, 411.1, 174; 478/357; 977/755, 932, 961

See application file for complete search history.

(56) References Cited

U.S. PATENT DOCUMENTS

| | | | | |
|---|---|---|---|---|
| 2005/0049355 | A1* | 3/2005 | Tang | B82Y 30/00 524/496 |
| 2005/0170177 | A1 | 8/2005 | Crawford et al. | |
| 2006/0052509 | A1* | 3/2006 | Saitoh | B82Y 30/00 524/496 |
| 2006/0188723 | A1* | 8/2006 | Rowley et al. | 428/408 |
| 2008/0023396 | A1 | 1/2008 | Fugetsu | |
| 2008/0044651 | A1* | 2/2008 | Douglas | B82Y 10/00 428/339 |
| 2009/0202764 | A1* | 8/2009 | Tonon | B60C 9/0042 428/36.3 |
| 2012/0077398 | A1* | 3/2012 | Gaillard | B29B 15/105 442/59 |

FOREIGN PATENT DOCUMENTS

| | | | |
|---|---|---|---|
| FR | 2880353 | A1 * | 7/2006 |
| JP | 11 350296 | | 12/1999 |
| JP | 2000 167457 | | 6/2000 |
| JP | 2003 73915 | | 3/2003 |
| JP | 2003 89969 | | 3/2003 |
| JP | 2003-239171 | A | 8/2003 |
| JP | 2005-54277 | A | 3/2005 |
| JP | 2005 256221 | | 9/2005 |
| JP | 2005 264400 | | 9/2005 |
| JP | 2005 539150 | | 12/2005 |
| JP | 2006 213839 | | 8/2006 |
| JP | 2007 39623 | | 2/2007 |
| JP | 2007 92234 | | 4/2007 |
| JP | 2007092234 | A * | 4/2007 |
| JP | 2010261108 | A * | 11/2010 |
| WO | WO 2005119772 | A2 * | 12/2005 |
| WO | WO 2006096203 | A2 * | 9/2006 |
| WO | WO 2007/130979 | A2 | 11/2007 |
| WO | 2009 028379 | | 3/2009 |
| WO | WO 2009028379 | A1 * | 3/2009 |
| WO | WO 2009/054415 | A1 | 4/2009 |

OTHER PUBLICATIONS

Merriam-Webster Online Dictionary, Lubricant, http://www.merriam-webster.com/dictionary/lubricant, copyright 2013.*

Schramm et al. Surfactants and their applications, Annu. Rep. Prog.Chem., Sect. C, 2003, 99, 3-48.*

International Search Report dated Oct. 27, 2009 in PCT/JP09/065159 filed Aug. 31, 2009.

U.S. Appl. No. 13/579,298, filed Aug. 16, 2012, Akiba, et al.

Extended European Search Report dated Jun. 14, 2012 in Patent Application No. 09811463.0.

Office Action dated Apr. 9, 2013, in Japanese patent Application No. 2008-224821 with English translation.

* cited by examiner

ELECTRO-CONDUCTIVE FIBERS WITH CARBON NANOTUBES ADHERED THERETO, ELECTRO-CONDUCTIVE YARN, FIBERS STRUCTURAL OBJECT, AND PRODUCTION PROCESSES THEREOF

CROSS-REFERENCE TO RELATED APPLICATIONS

This application is a National Stage of PCT/JP2009/065159 filed on Aug. 31, 2009. This application is based upon and claims the benefit of priority to Japanese Application No. 2008-224821 filed on Sep. 2, 2008.

BACKGROUND OF THE INVENTION

Technical Field

The present invention relates to electro-conductive fibers with carbon nanotubes adhered thereto, an electro-conductive yarn containing the electro-conductive fibers, and a fibers structural object (fabric) containing the electro-conductive fibers, as well as production processes thereof. More specifically, the present invention relates to electro-conductive fibers, an electro-conductive yarn, and an electro-conductive fibers structural object, each having nano (nm)-sized fine carbon nanotubes homogeneously and firmly adhered to a fiber surface thereof, as well as production processes thereof.

Background Art

Synthetic fibers such as polyester fibers, polyamide fibers, polyolefin fibers, or acrylic fibers have properties such as excellent mechanical properties, chemical resistance, weather resistance, and easiness in handling (or easy-to-handle), therefore the synthetic fiber is widely used for many purposes, including a clothing, a bedclothing, fiber products for interior, industrial materials, and medical materials.

However, a product with synthetic fibers easily generates static electricity (or electrostatic charges) by a cause such as friction. The generation of the static electricity spoils the beauty of the product due to attachment of dust or gives a person an electrical shock or unpleasant tactile sensing by discharge. In addition, the generation of static electricity sometimes causes a damage to an electronic apparatus due to spark on electrostatic discharge, or an ignition and explosion of an inflammable substance.

In order to solve the above-mentioned problems caused by the generation of the static electricity or the electrostatic charges, many techniques for imparting electro-conductivity to synthetic fibers or a fabric made of synthetic fibers have been proposed. As the representative conventional art, Japanese Patent Application Laid-Open No. 350296/1999 (JP-11-350296A, Patent Document 1) or Japanese Patent Application Laid-Open No. 73915/2003 (JP-2003-73915A, Patent Document 2) discloses a process which comprises mixing an electro-conductive particle (e.g., an electro-conductive carbon) into a polymer, subjecting the mixture to melt spinning or other means to give synthetic fibers having the electro-conductive particle kneaded therein, and producing a fabric and the like using the resulting synthetic fibers. Moreover, Japanese Patent Application Laid-Open No. 89969/2003 (JP-2003-89969A, Patent Document 3) or Japanese Patent Application Laid-Open No. 539150/2005 (JP-2005-539150A, Patent Document 4) discloses a fabric or the like in which an electro-conductive particle (e.g., a carbon black) is adhered to a surface of synthetic fibers or a surface of a fabric or the like made of synthetic fibers by a binder.

However, since electro-conductive particles (e.g., an electro-conductive carbons) directly-mixed into synthetic fibers scarcely and heterogeneously lie or appear on the surface of the fibers, the electro-conductive particles do not give electro-conductivity sufficiently, and a fabric made of those synthetic fibers is liable to vary in electro-conductivity.

Moreover, for synthetic fibers in which an electro-conductive particle (e.g., carbon blacks) is adhered to a surface of fibers by a binder, usually since it is necessary to adhere an electro-conductive particle having a size of the order of micron (μm) to a surface of synthetic fibers, synthetic fibers (monofilament) having a large fineness of not less than 20 dtex (decitex) are required. Such a large fineness tends to result in disadvantages such as a decreased softness (or flexibility) of the synthetic fibers, a deteriorated workability (such as knitting and weaving), and a lowered tactile sensing (or flexible feel). Further, the electro-conductive particle adhered to the fiber surface is easily peeled off due to friction, washing, or other reasons, and the durability of the electro-conductive performance deteriorates.

Furthermore, a product obtained by adhering an electro-conductive particle (e.g., a carbon black or a metal particle) to a fabric made of synthetic fibers by a means such as a binder has a low softness and easily causes peeling (or falling) off of the electro-conductive particle from the surface of the fabric.

Electromagnetic waves are now being widely used for various purposes such as broadcasting, mobile communication, radar, cellular phones, wireless LAN, and personal computers. In proportion to increase in the use, electromagnetic waves or magnetism have been scattered over life space, and there have been some problems, e.g., a disturbance of a human being due to electromagnetic waves or magnetism and an improper operation of an electronic apparatus. In this respect, synthetic fibers or synthetic fiber fabric to which an electromagnetic wave shielding performance is imparted by involving or adhering an electro-conductive metal particle in or to the fibers or fabric to make the fibers or fabric electro-conductive have been proposed. Such a fabric having an electromagnetic wave shielding performance is used for purposes such as a clothing, a wall-covering material, a cover for apparatus, and a partition with a view to protecting a human body and an electronic apparatus against an electromagnetic disturbance.

However, the conventional electromagnetic wave shielding synthetic fiber or fabric in which an electro-conductive metal particle is contained or adhered has some problems such as performance deterioration and dust generation due to peeling (or falling) off of the adhered metal particle or piece, and is still unsatisfactory.

On the other hand, since carbon nanotubes were discovered in Japan in 1991, use of the carbon nanotubes for various applications or products have been tried in order to take advantage of characteristics such as the excellent mechanical property, electro-conductive performance, anti-static performance, electromagnetic wave and magnetic shielding performance, and thermal stability. However, the carbon nanotubes are easily cohesive due to Van der Waals' force between the carbon nanotube molecules, which is accompanied by a formation of a "bundle structure" (bind structure) comprising a plurality of carbon nanotubes. As a result, the present situation is that an intrinsic size merit of the carbon nanotubes due to a size thereof, the above-mentioned properties such as excellent mechanical property, electric conductivity, and thermal stability are still insufficiently utilized.

As a method for adhering such carbon nanotubes to fibers, for example, Japanese Patent Application Laid-Open No. 264400/2005 (JP-2005-264400A, Patent Document 5) discloses a method for covering a surface of natural fibers with carbon nanotubes, which comprises immersing natural fibers in a processing slurry containing carbon nanotubes and a surfactant, wherein the mass ratio of the surfactant relative to the carbon nanotubes is 5 to 20. This document also discloses that examples of the surfactant include an anionic surfactant, a nonionic surfactant and a cationic surfactant, and that the preferred one is the anionic surfactant and the cationic surfactant. However, due to an ununiform covering of the carbon nanotubes on a surface of the fibers obtained by this method, the fibers have an insufficient electro-conductivity and low adhesion strength between the fibers and the carbon nanotubes, and the carbon nanotubes are easily peeled off from the fibers.

Further, Japanese Patent Application Laid-Open No. 213839/2006 (JP-2006-213839A, Patent Document 6) discloses an electro-conductive resin molded product which contains a fiber bundle having an electro-conductive agent adhered to a surface thereof, wherein the weight of the fiber bundle is 60 to 97% based on the total weight of the molded product. This document discloses a method for adhering an electro-conductive agent (e.g., carbon blacks, graphite, and carbon nanotubes) to a surface of an aromatic polyamide fiber bundle by an adhesive agent. However, due to an ununiform covering of the fiber surface with the carbon nanotubes, the molded product has an insufficient electro-conductivity, and the mechanical property of the fibers is also deteriorated.

On the other hand, as a method for dispersing carbon nanotubes homogeneously, Japanese Patent Application Laid-Open No. 39623/2007 (JP-2007-39623A, Patent Document 7) discloses a process for producing a carbon nanotube-dispersed paste, which comprises adhering an amphoteric molecule to a carbon nanotube aggregate to give a carbon nanotube-dispersed paste in which the aggregate is dispersed. This document discloses a dispersion obtained by dissolving the paste in a solution of a polar polymer (e.g., carrageenan and DNA). Incidentally, although this document discloses carbon nanotube-containing fibers in which alginic acid fibers containing carbon nanotubes are covered with a lactic acid-glycolic acid copolymer, synthetic fibers having a surface covered with carbon nanotubes and a production process of the synthetic fibers are not described in this document.

RELATED ART DOCUMENTS

Patent Documents

Patent Document 1: JP-11-350296A
Patent Document 2: JP-2003-73915A
Patent Document 3: JP-2003-89969A
Patent Document 4: JP-2005-539150A
Patent Document 5: JP-2005-264400A
Patent Document 6: JP-2006-213839A
Patent Document 7: JP-2007-39623A

SUMMARY OF THE INVENTION

Problems to be Solved by the Invention

It is therefore an object of the present invention to provide electro-conductive fibers in which carbon nanotubes are homogeneously and firmly (or strongly) adhered (or bonded or attached) to an almost whole of a surface of fibers [or electro-conductive fibers with carbon nanotubes homogeneously and firmly (or strongly) adhered (or bonded or attached) to an almost whole of a surface thereof] and which has an electro-conductivity and a softness, an electro-conductive yarn containing the electro-conductive fibers, and a fibers structural object containing the electro-conductive fibers, as well as production processes thereof.

Another object of the present invention is to provide electro-conductive fibers which have a prolonged maintenance of an electro-conductive performance due to a controlled peeling off of an electro-conductive particle from the fibers and has properties such as excellent softness, workability, tactile sensing (or texture or hand feeling), tactile impression, and lightness in weight, an electro-conductive yarn containing the electro-conductive fibers, and a fibers structural object containing the electro-conductive fiber, as well as production processes thereof.

It is additionally another object of the present invention to provide a process for producing electro-conductive fibers, an electro-conductive yarn and a fibers structural object, each having an electro-conductivity and a softness, easily and smoothly.

Means to Solve the Problems

The inventors of the present invention made intensive studies to achieve the above objects and finally found that immersion of synthetic fibers in a specific dispersion containing carbon nanotubes and drying of the fibers ensure to adhere an electro-conductive layer containing the carbon nanotubes to a surface of the synthetic fibers homogeneously and firmly over not less than 60% of the fiber surface. The inventors further found that by immersing synthetic fibers or a fibers structural object in a dispersion having carbon nanotubes dispersed therein with vibrating the synthetic fibers or the fibers structural object at a larger frequency than a predetermined frequency, the dispersion further permeates (or penetrates or enters) the inside of a multifilament bundle and a spun yarn, and the carbon nanotubes can be adhered to a whole surface of every single filament of the yarn (multifilament or spun yarn); and that a uniform electro-conductive layer is formed in the case of the use of a binder.

Moreover, the inventors of the present invention found the following: adhesion of a small amount of carbon nanotubes in extreme small size which have an excellent electro-conductivity to a surface of fibers minimizes the increase in mass caused by adhering the carbon nanotubes to the fibers or the fibers structural object and allows use of synthetic fibers having a small fiber diameter as the fibers, and therefore fibers or fibers structural object having properties such as excellent softness, tactile sensing (or texture), and workability in comparison with the conventional art and possessing an electro-conductive performance, an electro-conductive heat generation performance, an antistatic property, an electromagnetic wave and magnetic shielding property, and a heat conduction is obtained.

Furthermore, the inventors of the present invention found that, for adhering carbon nanotubes to a surface of synthetic fibers or a fiber surface of a fibers structural object, the carbon nanotubes can homogeneously be adhered to the fiber surface using a dispersion in which the carbon nanotubes are well dispersed as a fine particle without cohesion (or aggregation) in the presence of a surfactant (particularly a zwitterionic (or amphoteric) surfactant) as an aqueous dispersion containing carbon nanotubes; as well as that further addition of a binder to the aqueous dispersion allows more firm adhesion of the carbon nanotubes to the fiber surface. The present invention was accomplished based on the above various findings.

That is, the electro-conductive fibers of the present invention comprises synthetic fibers and an electro-conductive layer containing carbon nanotubes and covering (or coating) a surface of the synthetic fibers, and the coverage of the electro-conductive layer (or cover or covering) relative to the whole surface of the synthetic fibers is not less than 60% (particularly, not less than 90%). In the electro-conductive layer, the carbon nanotubes form a network structure on the fiber surface and are homogeneously and firmly adhered (or attached) to the fiber surface. The electro-conductive layer is formed on the fiber surface and has a uniform thickness which may range from 0.1 to 5 μm. The synthetic fibers may form a yarn, and the average fineness of the yarn may be about 10 to 1000 dtex. The electric resistance value of the electro-conductive fibers of the present invention at 20° C. may be, for example, selected from the range of $1\times10^{-2}$ to $1\times10^{10}$ Ω/cm in accordance with the purpose. The fibers may have a uniform standard deviation of a logarithm of an electric resistance value of less than 1.0. In particular, fibers having an electric resistance value of $1\times10^{-2}$ to $1\times10^{4}$ Ω/cm have an excellent electromagnetic wave and magnetic shielding property. When two electrodes are attached to the electro-conductive fibers of the present invention at an interval of 5 cm and a 12 V direct current or alternating current is applied on the fibers, the temperature of the fibers between the two electrodes may be raised by not lower than 2° C. after 60 seconds. The ratio of the carbon nanotubes is about 0.1 to 50 parts by mass relative to 100 parts by mass of the synthetic fibers. The electro-conductive layer may further contain a binder. The synthetic fibers may comprise at least one member selected from the group consisting of a polyester resin, a polyamide resin, a polyolefin resin, and an acrylic resin.

The present invention also includes an electro-conductive yarn containing the electro-conductive fibers (for example, a single yarn (or monofilament yarn), a two ply (plied) yarn (double-twisted yarn (or filament)), a multifilament, and a composite twisted yarn). The electro-conductive yarn of the present invention may be a two ply yarn, a multifilament, and a spun yarn. Moreover, the present invention includes an electro-conductive fibers structural object comprising the electro-conductive fibers and/or the electro-conductive yarn. In the electro-conductive fibers structural object, the surface leakage resistance value (or surface electric leakage resistance value) at 20° C. may be, for example, selected from the range of $1\times10^{-2}$ to $1\times10^{10}$ Ω/cm in accordance with the purpose, and the surface leakage resistance value after the fibers structural objective is washed 20 times in accordance with JIS (Japanese Industrial Standard) L 0217, No. 103 may be about 1 to 10000 times as large as the surface leakage resistance value before washing. In particular, fibers having a surface leakage resistance value of $1\times10^{-2}$ to $1\times10^{4}$ Ω/cm has an excellent electromagnetic wave and magnetic shielding property, and when two electrodes are attached to the fibers structural object at an interval of 5 cm and a 12 V direct current or alternating current is applied on the fibers structural object at 20° C., the temperature of the fibers structural object between the two electrodes may be raised by not lower than 2° C. after 60 seconds.

The present invention also includes a process for producing electro-conductive fibers, which comprises a step for adhering carbon nanotubes (CNTs) to a surface of synthetic fibers by using a dispersion containing the carbon nanotubes (or a CNT-dispersed solution) to form an electro-conductive layer containing the carbon nanotubes, and a step for drying the resulting synthetic fibers having the electro-conductive layer adhered to a surface thereof. In the drying step, the drying treatment may be conducted with heating. In this process, the synthetic fibers may be immersed in the dispersion with vibrating (e.g., vibrating at a frequency of not less than 20 Hz) the synthetic fibers to adhere the carbon nanotubes to the surface of the synthetic fibers and form the electro-conductive layer. The dispersion may contain a surfactant (particularly, a zwitterionic surfactant). The ratio of the surfactant is about 0.1 to 50 parts by mass relative to 100 parts by mass of the carbon nanotubes. The dispersion may contain a binder.

The present invention further includes an electro-conductive yarn containing electro-conductive fibers obtained by the production process of the electro-conductive fibers. The present invention also includes an electro-conductive fibers structural object formed from electro-conductive fibers and/or an electro-conductive yarn obtained by the production process of the electro-conductive fibers.

Incidentally, throughout this description, the "synthetic fibers" sometimes means a yarn (or multifilament) made of synthetic fibers (for example, a single yarn and a composite yarn). Further, the "fibers structural object" means not only a fabric (e.g., a woven fabric and a nonwoven fabric) but also a shaped product comprising such a fabric and a three-dimensional shaped fibers object.

Effects of the Invention

The electro-conductive fibers (including an electro-conductive yarn and synthetic fibers constituting an electro-conductive fibers structural object; the same applies hereinafter) of the present invention have carbon nanotubes homogeneously and firmly adhered to an almost whole of a fiber surface thereof. Therefore, the fibers have an excellent electro-conductivity. In addition, the adhesion of a small amount of the carbon nanotubes in extreme small size which have an excellent electro-conductivity, to the fiber surface minimizes the change (or increase) in mass caused by adhering the carbon nanotubes to the fibers and allows use of synthetic fibers having a small fiber diameter as the fibers, and therefore synthetic fibers having properties such as excellent softness, tactile sensing (or texture), workability, and easiness in handling in comparison with the conventional art are obtained. In particular, the electro-conductive fibers of the present invention have properties such as extremely excellent electro-conductive performance, electro-conductive heat generation performance, antistatic performance, electromagnetic wave and magnetic shielding performance, and heat conduction. Further, since the peeling off of the carbon nanotubes from the fiber surface due to washing, friction, or other reasons is hardly caused, the fibers have an excellent durability of each performance.

Furthermore, in a treatment with a dispersion, the carbon nanotubes can homogeneously be adhered to a synthetic fibers or a fibers structural object by vibrating (or microvibrating) the fibers of the fibers structural object (for example, at about 20 to 2000 Hz). In particular, when the fibers are a multifilament or a spun yarn (particularly, a multifilament), the dispersion permeates (or penetrates) the inside of a bundle of the multifilament or the spun yarn and the carbon nanotubes can be adhered over the inside of the fibers (particularly, a whole surface of every single filament of the multifilament) to give a uniform electro-conductive layer. The uniform electro-conductive layer ensures a stable electric resistance value in a threadline (or longitudinal) direction of the fibers. In addition to such a vibration treatment, use of a binder allows formation of a firmer electro-conductive layer.

Further, in the present invention, use of an aqueous dispersion obtained by dispersing carbon nanotubes in water in the presence of a surfactant (particularly, a zwitterionic surfactant) as a carbon nanotube dispersion ensures uniform adhesion of the carbon nanotubes to the fiber surface and provides fibers having a stable electric resistance value in a threadline direction thereof because the carbon nanotubes are well dispersed as a fine particle without cohesion (or aggregation) in the aqueous dispersion.

In particular, the electro-conductive fibers of the present invention, in which the carbon nanotubes form a uniform and thin-layered network structure and are firmly adhered to the fiber surface, are effectively available for various uses. These uses having the above-mentioned properties includes, for example, a clothing application (e.g., a working wear and a uniform) having an antistatic performance or an electromagnetic wave and magnetic shielding performance, an interior application (e.g., a curtain), a neutralizing bag filter, an electromagnetic wave shielding industrial material, a radiator, and a heating element sheet generating heat efficiently at a low voltage.

DESCRIPTION OF EMBODIMENTS

Figure 1:
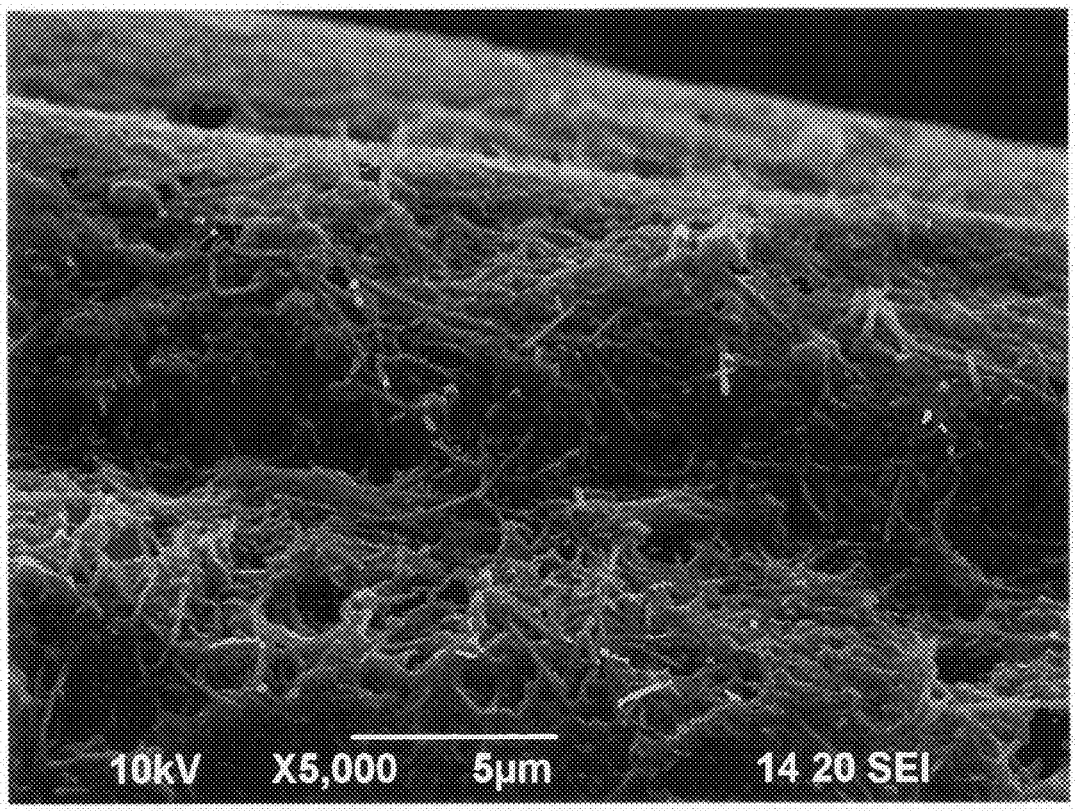
FIG. 1 represents a scanning electron microscope photograph of a cross section of electro-conductive fibers obtained in Example 1.

Hereinafter, the present invention will be illustrated in more detail.

[Electro-Conductive Fibers]

The present invention includes electro-conductive fibers in which a surface of synthetic fibers is covered with an electro-conductive layer containing carbon nanotubes (or electro-conductive fibers in which an electro-conductive layer containing carbon nanotubes is adhered to a surface of synthetic fibers), an electro-conductive yarn containing the electro-conductive fibers, and a fibers structural object containing the electro-conductive fibers and/or the electro-conductive yarn.

The synthetic fibers to be used in the present invention are fibers formed from a fiber-formable (or fiber-forming) synthetic resin or synthetic polymer material (synthetic organic polymer). The synthetic fibers to be used in the present invention may be formed from one species of a synthetic organic polymer (hereinafter, the synthetic organic polymer may simply be referred to as a "polymer") or may be formed from two or more species of polymers. The synthetic resin is not particularly limited to a specific one and may include, for example, a polyester resin [e.g., an aromatic polyester resin (e.g., a poly(alkylene arylate) resin such as a poly (ethylene terephthalate), a poly(trimethylene terephthalate), a poly(butylene terephthalate), or a poly(hexamethylene terephthalate); a fully aromatic polyester resin such as a polyarylate; and a liquid crystal polyester resin), and an aliphatic polyester resin (e.g., an aliphatic polyester and a copolymer thereof, such as a polylactic acid, a poly(ethylene succinate), a poly(butylene succinate), a poly(butylene succinate adipate), a hydroxybutylate-hydroxyvalerate copolymer, or a polycaprolactone)], a polyamide resin (e.g., an aliphatic polyamide and a copolymer thereof, such as a polyamide 6, a polyamide 66, a polyamide 610, a polyamide 10, a polyamide 12, or a polyamide 612; an alicyclic polyamide; and an aromatic polyamide), a polyolefin (or polyolefinic) resin (e.g., polyolefin and a copolymer thereof, such as a polypropylene, a polyethylene, an ethylene-propylene copolymer, a polybutene, or a polymethylpentene), an acrylic polymer (e.g., an acrylonitrile resin having an acrylonitrile unit, such as an acrylonitrile-vinyl chloride copolymer), a polyurethane resin (e.g., a polyester-based, polyether-based, or polycarbonate-based polyurethane resin), a polyvinyl alcohol polymer (e.g., a polyvinyl alcohol and an ethylene-vinyl alcohol copolymer), a polyvinylidene chloride resin (e.g., a polyvinylidene chloride, a vinylidene chloride-vinyl chloride copolymer, and a vinylidene chloride-vinyl acetate copolymer), and a polyvinyl chloride resin (e.g., a polyvinyl chloride, a vinyl chloride-vinyl acetate copolymer, and a vinyl chloride-acrylonitrile copolymer). These synthetic resins may be used alone or in combination.

When the synthetic fibers are formed from two or more species of polymers, the synthetic fibers may be blend spinning fibers formed from a mixture (alloy resin) of two or more species of polymers or may be a composite or multi-phase spinning fibers in which two or more species of polymers form a plurality of phase separation structure. The structure of the composite or multi-phase spinning fibers may include, for example, an islands-in-the-sea structure, a sheath-core structure, a side-by-side laminated structure, a structure comprising an islands-in-the-sea structure and a sheath-core structure in combination, and a structure comprising a side-by-side laminated structure and an islands-in-the-sea structure in combination.

Among these synthetic fibers, fibers comprising the polyester resin, the polyamide resin, the polyolefin resin, the acrylic polymer, or the like is preferred in the respect that such fibers have an excellent adhesive property (or adhesiveness) to the carbon nanotubes and an excellent durability. In particular, in view of wide use and thermal property, the preferred fibers include fibers comprising the polyester resin [particularly, a poly($C_{2-4}$alkylene terephthalate) resin (e.g., a poly(ethylene terephthalate) and a poly(butylene terephthalate))], the polyamide resin (particularly, an aliphatic polyamide resin such as a polyamide 6 or a polyamide 66), or the polyolefin resin (particularly, a polypropylene resin such as a polypropylene). In particular, polyester fibers are preferable in the respect that the fibers have excellent thermal stability and dimensional stability. Moreover, for each purpose, liquid crystal fibers (e.g., liquid crystal polyester fibers) having a high strength and a high elasticity can suitably be used.

The synthetic fibers may be continuous fibers (filament) or staple fibers (short fibers). The continuous fibers (filament) have a beneficial effect on a fabric to be used for a clothing application (e.g., a working wear and a uniform), an interior application (e.g., a curtain and a carpeting (a carpet)), a neutralizing bag filter, an electromagnetic waves shielding material, and other applications.

The cross-sectional form of the synthetic fibers is not particularly limited to a specific one. The synthetic fibers may be common synthetic fibers having a circular cross section or synthetic fibers having a modified (or deformed) cross section other than a circular cross section. For the fibers having a modified cross section, the cross-sectional form may be, for example, a square form, a polygonal form, a triangular form, a hollow form, a flat form, a multi-leaves form, a dog-bone form (I-shaped form), a T-shaped form, and a V-shaped form. Among these forms, a circular cross section is widely used in terms of easiness of uniform adhesion of the carbon nanotubes to fibers having the circular cross section, or other reasons.

Moreover, the synthetic fibers may form (or constitute) a yarn, and the fineness (average fineness) of the yarns is not particularly limited to a specific one. The fineness can be properly used, for example, in the range of 10 to 1000 dtex, depending on the fabric weight, softness, and rigidity (or stiffness) of a target fibers structural object. For example, when the yarn is used for an antistatic fabric for clothing having a low fabric weight, the fineness of the yarn is preferably a small fineness, such as about 10 to 50 dtex, in consideration for the design easiness for incorporating a small amount of the yarn in the fabric, the expression of an object performance and the cost performance by homogeneously dispersing a small amount of the synthetic fibers in the fibers structural object. On the other hand, for a carpeting or canvas use, a large fineness, such as not smaller than 100 dtex (e.g., about 100 to 1000 dtex), is preferred in respect of the durability of the fibers themselves.

The electro-conductive fibers of the present invention may be a yarn (or a filament) formed from the synthetic fibers alone or may be a composite yarn comprising the synthetic fibers and non-synthetic fibers (at least one member selected from the group consisting of natural fibers, regenerated fibers, and semi-synthetic fibers) in combination. Further, the yarn (or the filament) formed from the synthetic fibers alone may be a yarn such as a monofilament yarn, a two ply yarn, a multifilament yarn, a processed multifilament yarn, a spun yarn, a tape yarn, and a combination thereof. For the composite yarn [for example, a spun yarn formed by blend-spinning the synthetic fibers and at least one member selected from the group consisting of natural fibers (e.g., a cotton, a flax, a wool, and a silk), regenerated fibers (e.g., a rayon and a cupra) and semi-synthetic fibers (e.g., acetate fibers)], in order to adhere the electro-conductive layer (carbon nanotube) to the surface of the composite yarn successfully, it is preferable that the proportion of the synthetic fibers in the composite yarn be, for example, not less than 0.1% by mass, preferably not less than 10% by mass, and particularly not less than 30% by mass (e.g., 50 to 99% by mass). Moreover, it is preferable that the synthetic fibers account for not less than 0.1%, preferably not less than 10%, and particularly not less than 30% (e.g., 50 to 100%), of the surface of the composite yarn.

Moreover, the fineness (average fineness) of the composite yarn can be set according to the easiness in handling of the yarn with the carbon nanotubes adhered thereto (e.g., knitting and weaving properties, and twisting of the yarn and other fibers, and property of covering other fibers), the fabric weight of a fibers structural object formed from the composite yarn, and the softness and rigidity.

In the electro-conductive fibers of the present invention, the electro-conductive layer (carbon nanotubes) is preferably adhered to the surface of the synthetic fibers in not only part (or local area) of the fiber surface but also in a coverage (covering ratio) of not less than 50% (e.g., 50 to 100%), preferably not less than 90% (e.g., 90 to 100%), and more preferably whole (100%) of the fiber surface. The electro-conductive fibers having such a coverage have properties such as excellent electro-conductive performance, electro-conductive heat generation performance, antistatic performance, electromagnetic wave and magnetic shielding performance, and heat conduction performance.

Further, for the composite yarn, in order to impart properties such as excellent electro-conductive performance, electro-conductive heat generation performance, antistatic performance, electromagnetic wave and magnetic shielding performance, and heat conduction performance to the composite yarn, it is preferable that the electro-conductive layer (carbon nanotubes) be adhered to the surface of the yarn in a coverage of not less than 60% (e.g., 60 to 100%), preferably not less than 90% (e.g., 90 to 100%), and preferably whole (100%) of the surface of the synthetic fibers located in the surface of the yarn.

When the synthetic fibers or the composite yarn are/is not a monofilament yarn but a multifilament yarn or a spun yarn, it is not always necessary to adhere the electro-conductive layer (particularly the carbon nanotubes) to the fiber surface located in the inside of the yarn (the fiber surface which is not exposed to the yarn surface). The adhesion of the electro-conductive layer (particularly the carbon nanotubes) to not only the surface of the fibers located in the yarn surface but also the surface of the fibers located in the inside of the yarn further improves properties such as the electro-conductive performance, the electro-conductive heat generation performance, the antistatic performance, the electromagnetic wave and magnetic shielding performance, and the heat conduction performance of the synthetic fibers and composite yarn.

In order to adhere the carbon nanotubes to the inside of the spun yarn or that of the multifilament, it is preferable that the after-mentioned adhesion treatment of the carbon nanotubes using vibration be conducted. According to the present invention, among the above-mentioned fibers, a two ply yarn, a multifilament, and a spun yarn, particularly a multifilament, are preferably used in the respect that the effect of such an adhesion treatment is remarkably expressed. In order to allow the treatment using vibration to act effectively, in the case of the multifilament, the fineness of single fibers is, for example, about 0.1 to 50 dtex, preferably about 0.3 to 30 dtex, and more preferably about 0.5 to 20 dtex. Moreover, the total fineness of the multifilament is, for example, about 10 to 1000 dtex and preferably about 15 to 800 dtex. Further, the number of multifilaments is, for example, about 2 to 300, preferably about 5 to 200, and more preferably about 10 to 100. Furthermore, in the case of the twisted yarn, the twist number is, for example, about 200 to 5000 T/m and preferably about 1000 to 4000 T/m.

The ratio of the electro-conductive layer is about 0.1 to 100 parts by mass relative to 100 parts by mass of the synthetic fibers (or composite yarn). In particular, in order to impart the electro-conductivity to the synthetic fibers, the proportion of the carbon nanotubes is important. The adhesion amount (proportion) of the carbon nanotubes can be adjusted depending on conditions such as the species of the synthetic fibers (composite yarn), the application, the species of the carbon nanotubes, and the concentration of the carbon nanotube dispersion. Generally, the amount of the carbon nanotubes is, for example, about 0.1 to 50 parts by mass, preferably about 0.5 to 25 parts by mass, and more preferably about 1 to 20 parts by mass (particularly about 1 to 15 parts by mass) relative to 100 parts by mass of the synthetic fibers (composite yarn). The electro-conductive fiber with the carbon nanotubes adhered thereto in such a proportion is preferred in terms of properties such as the prevention of peeling off of carbon nanotubes from the synthetic fibers and the composite yarn, the electro-conductive performance, the electro-conductive heat generation performance, the antistatic performance, the electromagnetic wave and magnetic shielding performance, and the heat conduction performance.

Incidentally, the adhesion amount (proportion) of the carbon nanotubes does not contain the adhesion amount of the surfactant. Even when the carbon nanotubes are adhered to the surface of the synthetic fibers (composite yarn) by a binder, the adhesion amount (proportion) of the carbon nanotubes means the amount of the carbon nanotubes themselves and does not contain the adhesion amount of the binder.

Further, in the electro-conductive fibers of the present invention, the electro-conductive layer having a uniform thickness is adhered to the surface of the synthetic fibers. For example, the thickness of the electro-conductive layer in an almost whole surface of the synthetic fibers is, for example about 0.1 to 5 μm, preferably about 0.2 to 4 μm, and more preferably about 0.3 to 3 μm. The electro-conductive fibers of the present invention, which have such a uniform electro-conductive layer, is preferred in the respect that the peeling off of the carbon nanotubes is prevented and that the uniformity of the electro-conductive performance, electro-conductive heat generation performance, antistatic performance, electromagnetic wave and magnetic shielding performance, and heat conduction performance are obtained. In order to control the thickness, as described later, the synthetic fibers may be vibrated while treating the synthetic fibers with the dispersion. Thus, even in the case of a multifilament, the dispersion is permeated into the inside of a bundle of the multifilament by vibrating the synthetic fibers, and a uniform resin layer can be formed over the whole surface of every single filament of the multifilament.

The electro-conductivity suited to the purposes can be imparted to the electro-conductive fibers by adhering the carbon nanotubes to the surface of the synthetic fibers or the surface of the yarn comprising the synthetic fibers within the above-mentioned amount and thickness ranges. The electric resistance value of the electro-conductive fibers and the electro-conductive yarn at 20° C. may be selected from the range of $1\times10^{-2}$ to $1\times10^{10}$ Ω/cm depending on applications. For example, a fiber (or yarn) having an electric resistance value of about $1\times10^{-2}$ to $1\times10^{4}$ Ω/cm is available for electro-conductive fibers or electro-conductive yarn having excellent electro-conductive performance, electro-conductive heat generation performance, and electromagnetic wave and magnetic shielding performance. Moreover, fibers having an electric resistance value of about $1\times10^{5}$ to $1\times10^{9}$ Ω/cm (e.g., about $1\times10^{6}$ to $1\times10^{8}$ Ω/cm) are available for an application requiring an antistatic performance (e.g., an antistatic fabric). Further, fibers having an electric resistance value of about $1\times10^{9}$ to $1\times10^{10}$ Ω/cm are usable for an application such as a cleaning brush for copying machine. Moreover, the standard deviation of the logarithm of the resistance value (for example, the deviation of measurements at not less than 10 locations in a threadline direction) is less than 1.0, and a stable electro-conductive performance having less-scattered deviation in a threadline direction can be imparted to the fiber.

Further, since the electro-conductive layer is firmly adhered to the surface of the synthetic fibers, the electro-conductive fibers of the present invention have a high durability. After a washing operation in accordance with JIS L 0217, No. 103 is carried out 20 times, the electric resistance value is, for example, about 1 to 10000 times (e.g., about 1 to 1000 times), preferably about 1 to 100 times, and more preferably about 1 to 10 times as large as the electric resistance value before washing.

Further, electro-conductive fibers having an electric resistance value of $1\times10^{-2}$ to $1\times10^{4}$ Ω/cm also have an excellent electro-conductive heat generation performance. Concretely, when two electrodes are attached to the fibers at an interval of 5 cm and a 12 V direct current or alternating current is applied on the fibers at 20° C., the elevated temperature of the fibers between the two electrodes after 60 seconds is not lower than 2° C. (for example, about 2 to 100° C., preferably about 5 to 80° C., and more preferably about 10 to 50° C.). The degree of the temperature rise can be adjusted in accordance with the adhesion amount of the carbon nanotubes, and the ultimate temperature can be set for any purpose.

The characteristic structure of the carbon nanotubes is a tube structure having a diameter of several nm formed by wrapping a single sheet (or a one-atom-thick layer) of graphite having arranged 6-membered carbon rings (a graphene sheet) into a cylinder. The structure of the graphene sheet having the arranged 6-membered carbon rings may include various structures such as an armchair structure, a zigzag structure, and a chiral (spiral) structure. The graphene sheet may be a single sheet of graphite having a structure formed by a combination of a 6-membered carbon ring with a 5-membered carbon ring or a 7-membered carbon ring. As the carbon nanotubes, various carbon nanotubes, for example, single-walled carbon nanotubes comprising a single sheet of graphite, and multi-walled carbon nanotubes having a plurality of the above-mentioned cylindrical sheets arranged in a concentric configuration (multi-walled carbon nanotubes in which at least one of carbon nanotubes having a smaller diameter is in the inner side of carbon nanotubes having a lager diameter), carbon nanocones in which an end of single-walled carbon nanotubes is closed to form a circular cone, and carbon nanotubes having a fullerene in an inner side thereof are known. These carbon nanotubes may be used alone or in combination.

Among these carbon nanotubes, in order to improve the strength of the carbon nanotubes themselves, the multi-walled carbon nanotubes are preferred. Moreover, in terms of electro-conductivity, the structure of graphene sheet is preferably an armchair structure.

The production process of the carbon nanotubes to be used in the present invention is not particularly limited to a specific one, and the carbon nanotubes may be produced according to a conventional method.

Specifically, according to a chemical vapor deposition, the carbon nanotubes may be produced by heating a carbon-containing raw material [e.g., a hydrocarbon (such as benzene, toluene, or xylene), carbon monoxide, and an alcohol (such as ethanol)] in the presence of a catalyst [for example, a mixture of a transition metal compound (e.g., a transition metal (such as iron, cobalt, or molybdenum), ferrocene, and an acetate of the metal) and sulfur or a sulfur compound (such as thiophene or iron sulfide)]. That is, a fine fibrous (tubular) carbon is produced by heating the carbon-containing raw material and the catalyst to a temperature of not lower than 300° C. (for example, about 300 to 1000° C.) in gas [e.g., an inert gas (such as argon, helium, or xenon), and hydrogen] for gasification, introducing the resulting matter into a furnace, and further heating the resulting matter at a constant temperature within a range of 800 to 1300° C. (preferably 1000 to 1300° C.) to give a particulate of the catalyst metal and decompose the hydrocarbon. The resulting fibrous carbon has a low purity due to the presence of an unreacted raw material, a non-fibrous carbide, a tar, and the catalyst metal, and also has a low crystallinity. Accordingly, it is preferable that the resulting fibrous carbon be treated in a heat treating furnace in which a temperature (preferably a constant temperature) is maintained within a range of 800 to 1200° C. to remove a volatile component (such as the unreacted raw material or the tar). Further, in order to further promote a formation of a multi-walled structure of carbon nanotubes and evaporate the catalyst metal contained in carbon nanotubes, the fine fibrous carbon is annealed at a temperature of 2400 to 3000° C. to give carbon nanotubes.

The average diameter of the carbon nanotubes (a diameter in a direction perpendicular to an axial direction of the carbon nanotubes, or a diameter of a cross section of the carbon nanotubes) may be, for example, selected from about 0.5 nm to 1 μm (e.g., about 0.5 to 500 nm, preferably about 0.6 to 300 nm, more preferably about 0.8 to 100 nm, and particularly about 1 to 80 nm). For the single-walled carbon nanotubes, the average diameter is, for example, about 0.5 to 10 nm, preferably about 0.7 to 8 nm, and more preferably about 1 to 5 nm. For the multi-walled carbon nanotubes, the average diameter is, for example, about 5 to 300 nm, preferably 10 to 100 nm, and preferably 20 to 80 nm. The average length of the carbon nanotubes is, for example, about 1 to 1000 μm, preferably about 5 to 500 μm, and more preferably about 10 to 300 μm (particularly about 20 to 100 μm).

The electro-conductive layer may contain a surfactant which is contained in a dispersion used in the production step. As the surfactant, a zwitterionic (amphoteric) surfactant, an anionic surfactant, a cationic surfactant, or a nonionic surfactant may be used.

The zwitterionic surfactant may include various compounds such as a sulfobetaine compound, a phosphobetaine compound, a carboxybetaine compound, an imidazolium betaine compound, and an alkylamine oxide compound.

Examples of the sulfobetaine compound may include a salt of a di$C_{1-4}$alkyl$C_{8-24}$alkylammonio$C_{1-6}$alkanesulfonic acid (sulfonate) [e.g., 3-(dimethylstearylammonio)propanesulfonate, 3-(dimethylmyristylammonio)propanesulfonate, 3-(dimethyl-n-dodecylammonio)propanesulfonate, and 3-(dimethyl-n-hexadecylammonio)propanesulfonate], and an alkylammonio$C_{1-6}$alkanesulfonate having a steroid skeleton [e.g., 3-[(3-cholamidopropyl)dimethylammonio]-1-propanesulfonate (CHAPS) and 3-[(3-cholamidopropyl)dimethylammonio]-2-hydroxypropanesulfonate (CHAPSO)].

The phosphobetaine compound may include, for example, a $C_{8-24}$alkylphosphocholine (e.g., n-octylphosphocholine, n-dodecylphosphocholine, n-tetradecylphosphocholine, and n-hexadecylphosphocholine), a glycerophospholipid (e.g., lecithin), and a polymer of 2-methacryloyloxyethylphosphorylcholine.

Examples of the carboxybetaine compound may include a dimethyl$C_{8-24}$alkylbetaine (e.g., dimethyllaurylcarboxybetaine) and a perfluoroalkylbetaine. The imidazolium betaine compound may include, for example, a $C_{8-24}$ alkylimidazolium betaine such as laurylimidazolium betaine. The alkylamine oxide may include, for example, an amine oxide having a tri$C_{8-24}$alkyl group, such as lauryldimethylamine oxide.

These zwitterionic surfactants may be used alone or in combination. Incidentally, in the zwitterionic surfactant, the salt may include a salt with a basic compound such as ammonia, an amine compound (e.g., amine, and an alkanolamine such as ethanolamine), an alkali metal (e.g., sodium, and potassium), or an alkaline earth metal (e.g., calcium).

The anionic surfactant may include, for example, an alkylbenzenesulfonate (e.g., a $C_{6-24}$ alkylbenzenesulfonate such as sodium laurylbenzenesulfonate), an alkylnaphthalenesulfonate (e.g., a di$C_{3-8}$alkylnaphthalenesulfonate such as sodium diisopropylnaphthalenesulfonate), an alkylsulfonate (e.g., a $C_{6-24}$alkylsulfonate such as sodium dodecanesulfonate), a dialkyl sulfosuccinate (e.g., a di$C_{6-24}$alkyl sulfosuccinate such as sodium di-2-ethylhexyl sulfosuccinate), an alkylsulfate (e.g., a sulfated fat, a salt of a $_{6-24}$alkylsulfuric acid (such as a sodium salt of an ester of a reduced alcohol of palm oil with sulfuric acid), and a polyoxyethylene alkyl ether sulfate (where the average mole number of adducted oxyethylene units is about 2 to 3 mol)), and an alkylphosphate (e.g., a mono- to tri-$C_{8-18}$alkyl ester of a phosphoric acid such as mono- to tri-lauryl ether phosphoric acid, a polyoxyethylenealkyl ether phosphate). These anionic surfactants may be used alone or in combination. As the salt, the same salts as those of the above-mentioned zwitterionic surfactant may be exemplified.

Examples of the cationic surfactant may include a tetraalkylammonium salt (e.g., a mono- or di$C_{8-24}$alkyl-tri- or dimethylammonium salt such as lauryltrimethylammonium chloride or dioctadecyldimethylammonium chloride), a trialkylbenzylammonium salt [e.g., a $C_{8-24}$alkylbenzyldimethylammonium salt such as cetylbenzyldimethylammonium chloride (e.g., benzalkonium chloride)], and an alkylpyridinium salt (e.g., a $C_{8-24}$alkylpyridinium salt such as cetylpyridinium bromide). These cationic surfactants may be used alone or in combination. Incidentally, the salt may include a salt with an anionic compound such as a halogen atom (e.g., a chlorine atom and a bromine atom) or perchloric acid.

The nonionic surfactant may include, for example, a polyoxyethylene alkyl ether (e.g., a polyoxyethylene $C_{6-24}$alkyl ether such as a polyoxyethylene octyl ether, a polyoxyethylene lauryl ether, or a polyoxyethylene cetyl ether), a polyoxyethylene alkyl phenyl ether (e.g., a polyoxyethylene $C_{6-18}$alkyl phenyl ether such as a polyoxyethylene octyl phenyl ether or a polyoxyethylene nonyl phenyl ether), a polyoxyethylene polyhydric alcohol fatty acid partial ester [e.g., a polyoxyethylene glycerin $C_{8-24}$fatty acid ester such as a polyoxyethylene glycerin stearic acid ester, a polyoxyethylene sorbitan $C_{8-24}$fatty acid ester such as a polyoxyethylene sorbitan stearic acid ester, and a polyoxyethylene sucrose $C_{8-24}$fatty acid ester], and a polyglycerin fatty acid ester (e.g., a polyglycerin $C_{8-24}$fatty acid ester such as a polyglycerin monostearic acid ester). These nonionic surfactants may be used alone or in combination. Incidentally, in the nonionic surfactant, the average mole number of adducted ethylene oxide units is about 1 to 35 mol, preferably about 2 to 30 mol, and more preferably about 5 to 20 mol.

Among these surfactants, as the surfactant contained in the dispersion used in the production step, either combination use of the anionic surfactant and the cationic surfactant or use of the zwitterionic surfactant alone is preferred in order to prevent cohesion and bundle formation due to Van der Waals' force between carbon nanotube molecules and disperse the carbon nanotubes in a dispersion medium (e.g., water) stably and finely. In particular, the zwitterionic surfactant is preferably used. Therefore, when the synthetic fibers, the yarn comprising the synthetic fibers, and the fibers structural object are treated in the presence of the zwitterionic surfactant with the dispersion having the carbon nanotubes dispersed therein, the carbon nanotubes can homogeneously or equably be adhered to the fiber surface of the fibers, yarn, and structure.

As the zwitterionic surfactant, any zwitterionic surfactant as specifically listed above can be used. Among them, a sulfobetaine compound, particularly, a di$C_{1-4}$alkyl$C_{8-}$ $_{24}$alkylammonio$C_{1-6}$alkanesulfonate (such as 3-(dimethylstearylammonio)propanesulfonate or 3-(dimethylmyristylammonio)propanesulfonate) is preferred.

The ratio of the surfactant is, for example, about 0.01 to 100 parts by mass, preferably about 0.03 to 50 parts by mass, and more preferably about 0.05 to 30 parts by mass (particularly about 0.1 to 20 parts by mass) relative to 100 parts by mass of the carbon nanotubes. When the ratio of the surfactant is in this range, the electro-conductive layer has an improved uniformity of the carbon nanotubes and a maintained high electro-conductivity.

The electro-conductive layer may further contain a hydrate (a hydration stabilizer) in addition to the surfactant. In the dispersion used in the production step of the electro-conductive fibers, the hydration stabilizer contributes to promote the dissolution of the surfactant in a liquid medium (e.g., water) in order that the surface activity of the surfactant be sufficiently effective and to maintain the dispersion state until the carbon nanotubes as an electro-conductive layer are fixed on the fiber surface.

The species of the hydration stabilizer may depend on conditions such as the species of the surfactant and the species of the liquid medium (dispersion medium). When water is used as the liquid medium, for example, a compound such as the above-mentioned nonionic surfactant (when the nonionic surfactant is used as the surfactant) or a hydrophilic compound (water-soluble compound) may be used as the hydration stabilizer.

Examples of the hydrophilic compound (water-soluble compound) may include a polyhydric alcohol (e.g., glycerin, trimethylolpropane, trimethylolethane, pentaerythritol, sorbitol, xylitol, erythritol, and sucrose), a poly(alkylene glycol) resin (e.g., a poly($C_{2-4}$alkylene oxide) such as a poly (ethylene oxide) or a poly(propylene oxide)), a polyvinyl resin (e.g., a poly(vinylpyrrolidone), a poly(vinyl ether), a poly(vinyl alcohol), and a poly(vinyl acetal)), a water-soluble polysaccharide (e.g., carrageenan, and alginic acid or a salt thereof), a cellulose resin (e.g., an alkylcellulose such as a methylcellulose, a hydroxy$C_{2-4}$alkylcellulose such as a hydroxyethylcellulose or a hydroxypropylmethylcellulose, and a carboxy$C_{1-3}$alkylcellulose or a salt thereof, such as a carboxymethylcellulose), and a water-soluble protein (e.g., gelatin).

These hydration stabilizers may be used alone or in combination. Among these hydration stabilizers, the polyhydric alcohol such as glycerin is widely used.

The ratio of the hydration stabilizer is, for example, about 0.01 to 500 parts by mass, preferably about 1 to 400 parts by mass, and more preferably about 10 to 300 parts by mass relative to 100 parts by mass of the surfactant.

The electro-conductive layer may further contain a binder in addition to the surfactant. The binder improves the adhesiveness of the carbon nanotubes to the synthetic fibers. On the other hand, for an application requiring a surface conduction (e.g., an antistatic fabric or a cleaning brush for copying machine) among use applications of the electro-conductive fibers of the present invention, when the binder is used, it is necessary that the binder be adhered to the fiber surface in a state in which the carbon nanotubes lie or appear on the fiber surface (a state in which the surface of the carbon nanotubes is at least partly exposed without being entirely covered with the binder). In this respect, when the carbon nanotubes are adhered to the fiber surface in the presence of the binder, it is necessary to pay attention to conditions such as the amount of the binder and the properties thereof in order to avoid entire covering of the surface of the carbon nanotubes with the binder.

The binder may include a conventional adhesive resin, for example, a polyolefin resin, an acrylic resin, a vinyl acetate resin, a polyester resin, a polyamide resin, and a polyurethane resin. These adhesive resins may be used alone or in combination.

When water is used as the dispersion medium, among these binders, a hydrophilic adhesive resin (for example, an aqueous polyester resin, an aqueous acrylic resin, a vinyl acetate resin, and a urethane resin) is preferred.

As the aqueous polyester resin to be used, there may be a polyester resin obtainable (or obtained) by a reaction of a dicarboxylic acid component (e.g., an aromatic dicarboxylic acid such as terephthalic acid, and an aliphatic dicarboxylic acid such as adipic acid) with a diol component (e.g., an alkanediol such as ethylene glycol or 1,4-butanediol), wherein the polyester resin has a hydrophilic group introduced thereto. The method for introducing the hydrophilic group may include, for example, a method using a dicarboxylic acid component having a hydrophilic group (such as a sulfonate group or a carboxylate group) as the dicarboxylic acid component (e.g., 5-sodium sulfoisophthalate, and a polycarboxylic acid having three or more carboxyl groups), and a method using a poly(ethylene glycol) or a dihydroxycarboxylic acid as the diol component.

The aqueous acrylic resin may include, for example, a poly((meth)acrylic acid) or a salt thereof, a (meth)acrylic acid-(meth)acrylate copolymer, a (meth)acrylic acid-styrene-(meth)acrylate copolymer, a (meth)acrylic acid-vinyl acetate copolymer, a (meth)acrylic acid-vinyl alcohol copolymer, a (meth)acrylic acid-ethylene copolymer, and salts thereof.

The vinyl acetate resin is a polymer containing a vinyl acetate unit, or a saponification product thereof. For example, the vinyl acetate resin may be a poly(vinyl acetate), a (meth)acrylic acid-vinyl acetate copolymer, a vinyl acetate-maleic anhydride copolymer, a vinyl acetate-methyl (meth)acrylate copolymer, an ethylene-vinyl acetate copolymer, a poly(vinyl alcohol), and an ethylene-vinyl alcohol copolymer.

Further, as the binder, it is preferable to use the same type of an adhesive resin as the synthetic fibers. That is, for example, when the polyester resin is used for the synthetic fibers, it is preferable to use the aqueous polyester resin as the binder.

In order to smoothly adhere the carbon nanotubes to the fiber surface without entirely covering the surface of the carbon nanotubes with the binder, the ratio of the binder is, for example, about 50 to 400 parts by mass, preferably about 60 to 350 parts by mass, and more preferably about 100 to 300 parts by mass (particularly about 100 to 200 parts by mass) relative to 100 parts by mass of the carbon nanotubes.

Incidentally, according to the present invention, since the carbon nanotubes are adhered to the surface of the synthetic fibers through a mutual affinity, the binder is not necessarily needed. Even when the binder is not contained, the electro-conductive layer is firmly adhered to the surface of the synthetic fibers. That is, the electro-conductive fibers of the present invention may be fibers substantially free from the binder.

In particular, when the synthetic fibers comprise the polyester fibers, the carbon nanotubes are firmly adhered to the surface of the polyester fibers at a sufficient adhesion strength without the binder due to a high affinity of the polyester fibers and the carbon nanotubes. Use of a small amount of the binder further improves the adhesion strength of the carbon nanotubes to the fiber surface.

The electro-conductive layer may further contain a conventional additive, for example, a surface-treating or finishing agent (e.g., a coupling agent such as a silane coupling agent), a coloring agent (e.g., a dye and a pigment), a color-improving agent, a dye-fixing agent, a brightener (or a brightening agent), a metal-corrosion inhibitor, a stabilizer (e.g., an antioxidant and an ultraviolet ray absorbing agent), a dispersion stabilizer, a thickener or a viscosity controlling agent, a thixotropy-imparting agent, a leveling agent, a defoaming agent, a bactericide, and a filler. These additives may be used alone or in combination.

[Electro-Conductive Fibers Structural Object]

The electro-conductive fibers structural object of the present invention comprises the above-mentioned electro-conductive fibers and/or the above-mentioned electro-conductive yarn. The electro-conductive fibers structural object may comprise the electro-conductive synthetic fibers and/or the yarn made of the electro-conductive synthetic fibers (such as a single yarn or a composite yarn) alone, or may further comprise non-electro-conductive synthetic fibers and/or the above-mentioned non-synthetic fibers. Incidentally, the electro-conductive layer may be adhered to the non-synthetic fibers in addition to the synthetic fibers. In particular, for the electro-conductive fibers structural object obtained by adhering an electro-conductive layer to a fibers structural object comprising non-electro-conductive fibers, it is often the case that the electro-conductive layer is adhered to the non-synthetic fibers in a process for adhering the electro-conductive layer to the synthetic fibers.

Examples of the fibers structural object in the present invention may include a fabric [for example, a woven fabric (e.g., a plane weave fabric (such as a taffeta fabric), a twill fabric, a satin fabric, and a pile fabric), a knitted fabric [e.g., plain knit fabric, a circular knit fabric, an interlock fabric, a rib stitch fabric, and a pile stitch fabric], a nonwoven fabric (e.g., a wet-laid nonwoven fabric, a dry-laid nonwoven fabric, and a spunbonded nonwoven fabric), a lace fabric, and a net] and a fibrous molded (or formed) product (e.g., a sheet comprising a plurality of fabrics, a plate, and a three-dimensional molded (or formed) product).

The fibers structural object of the present invention is roughly classified into two groups: a fibers structural object formed from electro-conductive fibers as a raw material, and a fibers structural object obtained by adhering an electro-conductive layer to a raw fibers structural object comprising non-electro-conductive fibers. In a non-limiting manner, for example, with respect to the former fibers structural object, examples of a fibers structural object comprising the electro-conductive fibers in combination with non-electro-conductive synthetic fibers and/or non-electro-conductive non-synthetic fibers may include a woven fabric obtained by using electro-conductive fibers or an electro-conductive yarn (e.g., a polyester multifilament yarn having carbon nanotubes adhered thereto) as part of the warp and/or weft on the occasion of a formation of a woven fabric from a commonly used polyester textured yarn, a knitted fabric obtained by using electro-conductive fibers or an electro-conductive yarn (e.g., a polyester multifilament yarn having carbon nanotubes adhered thereto) as part of the knitting yarn on the occasion of a formation of a knitted fabric from a commonly used polyester textured yarn, and a nonwoven fabric comprising electro-conductive staple fibers and non-electro-conductive staple fibers (synthetic fibers, non-synthetic fibers) in combination. The proportion of the electro-conductive fibers and/or the electro-conductive yarn in these fiber assemblies can be adjusted depending on purposes such as the species of the fibers structural object to be formed and the application of the fibers structural object. The proportion of the electro-conductive fibers and/or the electro-conductive yarn in the whole fibers structural object is, for example, about not less than 1% by mass (e.g., about 1 to 100% by mass), preferably about 10 to 100% by mass, and more preferably 30 to 100% by mass (particularly about 50 to 100% by mass).

With respect to the latter fibers structural object, when a raw fibers structural object containing non-synthetic fibers is used, in order to well adhere the carbon nanotubes to a surface of fibers contained in the raw fibers structural object, it is preferable that not less than 0.1% by mass (e.g., 0.1 to 100% by mass), preferably not less than 10% by mass (e.g., 10 to 100% by mass), and more preferably not less than 30% by mass (e.g., 30 to 100% by mass) of fibers and/or a yarn (a single yarn or a composite yarn) contained in the raw fibers structural object be the synthetic fibers and/or a yarn made of the synthetic fibers. In particular, the proportion of the synthetic fibers and/or the yarn made of the synthetic fibers in the fibers and/or the yarn located in the surface of the fibers structural object is preferably above-mentioned not less than 30% by mass (e.g., 30 to 100% by mass), preferably 50 to 100% by mass, and more preferably 70 to 100% by mass (particularly 90 to 100% by mass).

In the electro-conductive fibers structural object of the present invention, in which the carbon nanotubes are adhered to the fiber surface, it is preferable that the electro-conductive layer (the carbon nanotube) be adhered to the fiber surface in a coverage of not less than 60% (e.g., 60 to 100%), preferably not less than 90% (e.g., 90 to 100%), and more preferably all (100%) of the surface of the fibers located in the surface of the fibers structural object. The fibers structural object having such a coverage has properties such as excellent electro-conductive performance, electro-conductive heat generation performance, antistatic performance, electromagnetic wave and magnetic shielding performance, and heat conduction performance. Although it is not always necessary to adhere the electro-conductive layer (particularly the carbon nanotubes) to the surface of the fibers located in the inside of the fibers structural object, the adhesion of the electro-conductive layer to not only the surface of the fibers located in the surface of the fibers structural object but also the surface of the fibers located in the inside of the fibers structural object further improves properties such as the electro-conductive performance, the electro-conductive heat generation performance, the antistatic performance, the electromagnetic wave and magnetic shielding performance, and the heat conduction of the fibers structural object.

The proportion of the electro-conductive layer and the carbon nanotubes in the electro-conductive fibers structural object is the same as that in the electro-conductive fibers even in the case of the electro-conductive fibers structural object obtained by adhering the electro-conductive layer to the raw fibers structural object.

Incidentally, even in the case of the fibers structural object, in the same manner as in the case of the synthetic fibers, the raw fibers structural object may be treated with the dispersion while vibrating the synthetic fibers contained in the fibers structural object from the point of view of imparting a uniform electro-conductivity to the fiber surface by forming an electro-conductive layer having a uniform thickness.

The electro-conductivity adequate for the purpose can be imparted to the fibers structural object by adhering the carbon nanotubes in the above-mentioned amount and thickness to the surface of the fibers contained in the fibers structural object. The surface leakage resistance value (JIS L 1094) of the electro-conductive fibers structural object at 20° C. may be selected from the range of, for example, $1\times10^{-2}$ to $1\times10^{10}$ Ω/cm according to the application. For example, the fibers structural object having a surface leakage resistance value of about $1\times10^{-2}$ to $1\times10^{4}$ Ω/cm can be used as an electro-conductive fibers structural object (fabric) having excellent electro-conductive performance, electro-conductive heat generation performance, and electromagnetic wave and magnetic shielding performance. Moreover, the fibers structural object having a surface leakage resistance value of about $1\times10^{5}$ to $1\times10^{9}$ Ω/cm can be used as a fabric having an antistatic performance.

Further, the electro-conductive fibers structural object of the present invention has a high durability since the electro-conductive layer is firmly adhered to the surface of the synthetic fibers. The surface leakage resistance value after washing in accordance with JIS L 0217, No. 103 is, for example, about 1 to 10000 times (e.g., about 1 to 1000 times), preferably about 1 to 100 times, and more preferably about 1 to 10 times (particularly about 1 to 5 times) as large as the surface leakage resistance value before washing.

Further, the fibers structural object having a surface leakage resistance value of about $1\times10^{-2}$ to $1\times10^{4}$ Ω/cm can be used as an electro-conductive heat-generating fabric due to an excellent electro-conductive heat-generation performance thereof. When two electrodes are attached to the fibers structural object at an interval of 5 cm and a 12 V direct current or alternating current is applied on the fibers structural object between the two electrodes at 20° C., the elevated temperature of the fibers structural object between the two electrodes after 60 seconds is, for example, not lower than 2° C. (e.g., about 2 to 100° C., preferably about 5 to 80° C., and more preferably about 10 to 50° C.).

[Production Process of Electro-Conductive Fibers and Fibers Structural Object]

The electro-conductive fibers of the present invention is produced through a step for adhering the electro-conductive layer containing the carbon nanotubes to the surface of the synthetic fibers by using the dispersion containing the carbon nanotubes, and then a step for drying the synthetic fibers having the electro-conductive layer adhered to a surface thereof.

In the adhesion step of the electro-conductive layer, the concentration of the carbon nanotubes in the dispersion is not particularly limited to a specific one. Depending on an intended electric resistance value or surface leakage resistance value, the amount of the carbon nanotubes relative to the total mass of the dispersion may suitably be selected from the range of 0.1 to 30% by mass (particularly 0.1 to 10% by mass). Also when the binder is used, the amount of the carbon nanotubes may be selected from such a range in order that the ratio of the binder relative to the carbon nanotubes may be a desired value.

The dispersion medium (liquid medium) for dispersing the carbon nanotubes may include, for example, a conventional polar solvent (e.g., water, an alcohol, an amide, a cyclic ether, and a ketone), a conventional hydrophobic solvent (e.g., an aliphatic or aromatic hydrocarbon, and an aliphatic ketone), or a mixed solvent thereof. Among these solvents, water is preferably used in terms of convenience (or simplicity) or operationality.

Moreover, in order to stably disperse the carbon nanotubes in the liquid medium (e.g., water) without cohesion (or aggregation), it is preferable that the carbon nanotube dispersion used for the treatment contain the above-mentioned surfactant. The amount of the surfactant may be selected, for example, from the range of about 1 to 100 parts by mass (particularly about 5 to 50 parts by mass) relative to 100 parts by mass of the carbon nanotubes.

In the case of the carbon nanotube dispersion containing the surfactant (particularly the zwitterionic surfactant), in order to promote the dissolution of the surfactant to the liquid medium (e.g., water) and exhibit the surface activity sufficiently, it is preferable that a hydrate (hydration stabilizer) be added to the dispersion.

The amount (or ratio) of the hydration stabilizer may be selected from the range of about 10 to 500 parts by mass (particularly about 50 to 300 parts by mass) relative to 100 parts by mass of the surfactant.

The preparation method of the dispersion is not particularly limited to a specific one, and any method may be used as long as the a dispersion in which the carbon nanotubes are stably and finely dispersed in the liquid medium (e.g., water) can be prepared without causing cohesion (or aggregation) or bundle formation of the carbon nanotubes.

In particular, according to the present invention, the preferred preparation method includes a method comprising dispersion-treating the carbon nanotubes in an aqueous medium (water) in the presence of the surfactant (particularly the zwitterionic surfactant) while holding the pH of the aqueous medium to 4.0 to 8.0, preferably 4.5 to 7.5, and more preferably 5.0 to 7.0. The dispersion treatment in this preparation method preferably uses a mill (a media mill) using a medium (a solid medium for crushing, such as a bead or a ball) as a dispersion apparatus. Concrete examples of the media mill include a bead mill using a zirconia bead or the like, and a ball mill. In the case of the bead mill, a bead (e.g., a zirconia bead) having a diameter of 0.1 to 10 mm and preferably 0.1 to 1.5 mm is preferably used. In particular, the dispersion may be prepared as follows: carbon nanotubes and a surfactant (and optionally a component such as a binder) are pre-mixed or pre-dispersed in an aqueous medium using a dispersion apparatus (e.g., a ball mill) to obtain a paste product, and then the paste product and another aqueous medium containing a surfactant are added in a bead mill to give a dispersion.

In the dispersion obtained by this preparation method, the carbon nanotubes are stably dispersed in a finely dispersed state in the aqueous medium without causing cohesion (or aggregation) and bundle formation due to Van der Waals' force between carbon nanotube molecules through the agency of the surfactant. Therefore, the treatment with this dispersion allows uniform adhesion of the carbon nanotubes to the fiber surface.

The treatment method of the synthetic fibers with the dispersion of the carbon nanotubes is not particularly limited to a specific one. Any method may be used as long as the electro-conductive layer containing the carbon nanotubes can homogeneously be adhered to the fiber surface of the synthetic fibers. Such a treatment method may include, for example, an immersion method of the synthetic fibers in the dispersion of the carbon nanotubes, a treatment method of the synthetic fibers with the dispersion of the carbon nanotubes using a covering apparatus (or a coating apparatus) (e.g., a sizing apparatus equipped with a touch roller, a doctor blade, a pad, a spray apparatus, and a yarn printing apparatus).

The temperature in the treatment with the dispersion is not particularly limited to a specific one, and may be, for example, selected from the range of about 0 to 150° C. The temperature is preferably about 5 to 100° C., more preferably about 10 to 50° C., and usually an ordinary (or room) temperature.

Among these treatment methods, an immersion method of the synthetic fibers in the dispersion of the carbon nanotubes and a yarn printing method are preferred since such a method allows formation of a uniform electro-conductive layer. Further, in the adhesion treatment with the dispersion, it is preferred to vibrate the synthetic fibers. When the fibers are treated with giving vibration, the dispersion permeates the inside of the spun yarn, the inside of the multifilament bundle, and the inside of the fibers structural object to form a uniform electro-conductive layer over the inside of the fibers or the whole surface of every single filament constituting the spun yarn or multifilament.

It is sufficient that the frequency of the vibration is, for example, not less than 20 Hz. The frequency is, for example, about 20 to 2000 Hz, preferably about 50 to 1000 Hz, and more preferably about 100 to 500 Hz (particularly about 100 to 300 Hz).

The means for giving vibration is not particularly limited to a specific one, and may include a conventional means, for example, a mechanical means and an ultrasonic means. The mechanical means may be, for example, a method for vibrating the fibers by vibrating a yarn guide for guiding the fibers to an apparatus such as a sizing apparatus or an immersion bath, by vibrating the sizing apparatus itself or the immersion bath itself, or by vibrating the dispersion.

The adhesion treatment with the dispersion may be one-time operation or may comprise repeating the same operation two or more times.

In the drying step, the liquid medium is removed from the synthetic fibers treated with the dispersion of the carbon nanotubes, and the resulting matter is dried to obtain the electro-conductive fibers of the present invention, in which the carbon nanotubes are homogeneously adhered in a state of a thin layer as an electro-conductive layer to the fiber surface.

The drying temperature may be selected according to the species of the liquid medium (dispersion medium) in the dispersion. When water is used as the dispersion medium, the drying temperature to be used is usually about 100 to 230° C. (particularly about 110 to 200° C.) depending on the material of the synthetic fibers. For the polyester fibers, the drying temperature may be, for example, about 120 to 230° C. (particularly about 150 to 200° C.).

The electro-conductive fibers structural object of the present invention may be produced from the electro-conductive fibers and/or the electro-conductive yarn or may be produced by treating the fibers structural object comprising the non-electro-conductive synthetic fibers and/or the non-electro-conductive yarn with the dispersion containing the carbon nanotubes. The production conditions are the same as those of the production process of the electro-conductive fibers. In particular, in the case of the fabric, the treatment with the dispersion preferably includes an immersion in the dispersion (a dep-nip method). Also, in the case of the fibers structural object, the treatment of the fibers structural object with giving vibration is preferred since the carbon nanotubes can permeate the inside of the structure.

INDUSTRIAL APPLICABILITY

The electro-conductive fibers, electro-conductive yarn, and fibers structural object of the present invention have properties such as excellent electro-conductive performance, electro-conductive heat generation performance, antistatic performance, electromagnetic wave and magnetic shielding performance, heat-generating property from sheet surface, and heat conduction performance, since the fine carbon nanotubes are homogeneously and firmly adhered to the surface of the synthetic fibers which are a component of the electro-conductive fibers, the electro-conductive yarn, or the fibers structural object. Further, the peeling off of the carbon nanotubes from the fiber surface due to washing, friction, or other reasons is hardly caused. Furthermore, the electro-conductive fibers, the electro-conductive yarn, and the fibers structural object have an excellent durability of each performance described above and also have properties such as excellent softness, tactile sensing (or texture), easiness in handling, and workability. Therefore, by making the most use of the above-mentioned properties, the electro-conductive fibers, the electro-conductive yarn, and the fibers structural object are effectively available for various uses, for example, a clothing application (e.g., a working wear and a uniform) having an antistatic performance or an electromagnetic wave and magnetic shielding performance, an interior application (e.g., a curtain, a carpeting, a wall-covering material, and a partition), a neutralizing bag filter, a cover for apparatus, a brush for copying machine, and an electromagnetic wave shielding industrial material. In addition, the electro-conductive fibers, the electro-conductive yarn, and the fibers structural object are also effectively available for a nonmetallic heating element sheet. The heating element comprising the electro-conductive fibers of the present invention generates heat at a low voltage, is thin, lightweight, and compact, and has an excellent bending durability. The heating element sheet is fit for various uses and is widely used for, e.g., a snow melter, an anti-freezing apparatus, a road heater, a vehicle sheet, a floor heating system, a wall heating system, and a heat generating and insulating clothing. Moreover, since the electro-conductive fibers having a low resistance value are lightweight and compact as a nonmetallic electric wire and have an excellent bending durability, the electro-conductive fibers are used as a substitute for a metallic electric wire.

Further, according to the production process of the present invention, the electro-conductive fibers, the electro-conductive yarn, and the electro-conductive fibers structural object, each having the carbon nanotubes firmly adhered to the fiber surface, are produced smoothly and certainly, and the production process is of much practical use.

EXAMPLES

The following examples are intended to describe this invention in further detail and should by no means be interpreted as defining the scope of the invention. In the following examples, each of physical and other properties was measured and evaluated as follows. Incidentally, "%" indicates "% by mass" unless otherwise stated.

(1) Adhesion Amount of Carbon Nanotubes in Fibers Structural Object (Woven Fabric) and Yarn:

The mass of a cloth (in the case of a yarn, a fineness of a yarn) before adhering carbon nanotubes (the mass of an original cloth) was subtracted from the mass of the cloth (in the case of the yarn, the fineness of the yarn) after adhering the carbon nanotubes. The resulting difference was divided by the mass of the original cloth to give a ratio of the carbon nanotubes (or a total ratio of the carbon nanotubes and a binder); and the adhesion amount of the carbon nanotubes per unit mass of the original cloth (in the case of the yarn, per unit mass of the original yarn) was calculated, taking the ratio of the carbon nanotubes and the binder into account when the binder was used.

(2) Electric Resistance Value of Electro-Conductive Yarn:

Twenty (20) test pieces, each having a length of 10 cm, were cut out from an electro-conductive yarn (electro-conductive multifilament yarn) every 100 m along a thread-line direction of the yarn. Each test piece having a length of 10 cm was placed on an electrode box "SME-8350" manufactured by Toa Electronics Ltd., and a 1000 V voltage was applied between the both ends of the test piece. Each electric resistance value (Ω/cm) of the 20 test pieces was measured under a measurement environment condition of 20° C. and 30% RH using an ohmmeter "SME-8220" manufactured by Toa Electronics Ltd. The maximum value and the minimum value were excluded from the measured values, and the average value of the remaining 18 test pieces was calculated to give an electric resistance value (Ω/cm) of the yarn.

(3) Standard Deviation of Logarithm of Electric Resistance Value:

Regarding each of the 18 data used for the calculation of the average value out of 20 electric resistance values measured in the above "(2) Electric resistance value of electro-conductive yarn", the logarithm was calculated, and the standard deviation of the logarithm was determined.

(4) Surface Leakage Resistance Value of Fibers Structural Object (Woven Fabric):

In accordance with JIS L 1094, the surface leakage resistance value of the fibers structural object (woven fabric) was measured.

(5) Washing Treatment and Fastness of Fibers Structural Object (Woven Fabric):

In accordance with JIS L 0217, No. 103, the washing (laundering) was carried out, and the fastness after the washing (the color fastness to washing and laundering) (washing fastness: change in color and staining) was evaluated in accordance with JIS L 0844, "No. A-2".

Example 1

(1) Preparation of Aqueous Carbon Nanotube Dispersion:

(i) An aqueous solution of the surfactant (pH 6.5) was prepared by mixing 2.0 g of 3-(dimethylstearylammonio) propanesulfonate (a zwitterionic surfactant), 5 ml of glycerin (a hydration stabilizer), and 495 ml of deionized water.

(ii) In a ball mill body (cylinder type, internal volume=1800 ml, ball diameter=150 mm, and filling amount of ball=3200 g), 500 ml of the aqueous solution of the surfactant obtained in the above step (i) and 15.2 g of carbon nanotubes ("MWCNT-7" manufactured by Nano Carbon Technologies Co., Ltd.) were put, and the mixture was stirred by hand to give a paste product. Then the ball mill body was placed on a rotating stand ("AS ONE" manufactured by ASAHI RIKA SEISAKUSYO, Co., Ltd.), and the paste product was stirred for one hour to give a liquid product containing the carbon nanotubes.

(iii) The whole quantity of the liquid product containing the carbon nanotubes produced in the above step (ii) was removed from the ball mill body. To the liquid product were added another 500 ml of an aqueous solution of a surfactant prepared in the same manner as in the above step (i), and further added 25.5 g of a binder ("MEIBINDER NS" manufactured by Meisei Chemical Works, Ltd., a polyester binder) in terms of solid contents. The mixture was charged in a bead mill ("DYNO-MILL" manufactured by WAB, cylindrical type, internal volume=2000 ml, 1800 g of zirconia bead having a diameter of 0.6 mm filled therein) and stirred at a rotation frequency of 300 rpm for 60 minutes to prepare an aqueous carbon nanotube dispersion containing the zwitterionic surfactant [carbon nanotube concentration=1.48 w/w %, binder content=1.92 w/w %]. Incidentally, the pH of the aqueous dispersion was maintained at 5.5 to 7.0 during stirring using the bead mill.

(2) Adhesion Treatment of Carbon Nanotubes to Polyester Textured Yarn:

(i) A commercial available polyester POY (partially oriented yarn) (polyester POY30/24 manufactured by NAN YA) was 2H false-twisted in the usual manner to give a woolly textured yarn having a fineness of 24 dtex. The textured yarn was immersed in the aqueous carbon nanotube dispersion obtained in the above step (1) by a commonly used sizing manner, where the yarn was vibrated at 200 Hz through a vibrated yarn guide throughout the immersion. Then the yarn was dried at 170° C. for 2 minutes to give a polyester textured yarn having the carbon nanotubes adhered thereto and having a fineness of 27 dtex.

(ii) The adhesion amount of the carbon nanotubes to the polyester textured yarn obtained in the above step (i) was measured according to the above-mentioned method. The adhesion amount was 0.016 g per gram of the polyester textured yarn, the electric resistance value was $4.9\times10^5$ Ω/cm, and the standard deviation of the logarithm of the electric resistance value was 0.72. Further, an observation of the surface of the textured yarn by a light microscope revealed that the substantially whole surface of the textured yarn was covered with the carbon nanotubes to be black appearance, that an area uncovered with the carbon nanotubes was not found substantially, and that the surface coverage was 100%. Furthermore, after observing the cross section of the textured yarn by SEM, it was found that an electro-conductive layer was formed on the surface of the textured yarn and that the layer contained the carbon nanotubes and had an almost uniform thickness of 0.3 to 1.0 μm. FIG. 1 represents a SEM photograph of the surface of the resulting textured yarn (electro-conductive fiber). The carbon nanotubes are stacked like a network layer on the surface of the fibers to form the electro-conductive layer.

(3) Production of Woven Fabric:

(i) The polyester textured yarn with the carbon nanotubes adhered thereto, which was obtained in the above step (2), and a commercial available polyester textured yarn (a polyester woolly textured yarn, 84T-36, manufactured by NAN YA) were twisted together to give a composite yarn. A commercial available polyester textured yarn (a polyester woolly textured yarn, 84T-36, manufactured by NAN YA) was used for producing a woven fabric in the usual manner with the proviso that the composite yarn was interwoven at intervals of 5 mm with the warp and interwoven at intervals of 5 mm with the weft, to give a woven fabric in which the textured yarn with the carbon nanotubes adhered thereto was interwoven (taffeta, fabric weight=80 g/m$^2$).

(ii) The surface leakage resistance value of the woven fabric obtained in the above step (i) was $5.7\times10^5$ Ω/cm before washing and $7.7\times10^6$ Ω/cm after washing 20 times (each washing was conducted in accordance with JIS L 0217, No. 103), and the woven fabric showed an excellent washing durability.

Moreover, the washing fastness of the woven fabric obtained in the above step (i) was excellent, having Grade 5 of change in color and Grade 5 of staining.

Example 2

(1) Preparation of Aqueous Carbon Nanotube Dispersion:

(i) An aqueous solution of the surfactant (pH 6.5) was prepared by mixing 2.0 g of 3-(dimethylstearylammonio)

propanesulfonate (a zwitterionic surfactant), 5 ml of glycerin (a hydration stabilizer), and 495 ml of deionized water.

(ii) In a ball mill body (cylinder type, internal volume=1800 ml, ball diameter=150 mm, and filling amount of ball=3200 g), 500 ml of the aqueous solution of the surfactant obtained in the above step (i) and 30.4 g of carbon nanotubes (Baytube, manufactured by Bayer) were put, and the mixture was stirred by hand to give a paste product. Then the ball mill body was placed on a rotating stand ("AS ONE" manufactured by Asahi Rika Kenkyusho, Co., Ltd.), and the paste product was stirred for one hour to give a liquid product containing the carbon nanotubes.

(iii) The whole quantity of the liquid product containing the carbon nanotubes produced in the above step (ii) was removed from the ball mill body. To the liquid product were added another 500 ml of an aqueous solution of a surfactant prepared in the same manner as in the above step (i), and further added 30.0 g of a binder ("MEIBINDER NS" manufactured by Meisei Chemical Works, Ltd., a polyester binder) in terms of solid contents. The mixture was charged in a bead mill ("DYNO-MILL" manufactured by WAB, cylindrical type, internal volume=2000 ml, 1800 g of zirconia bead having a diameter of 0.6 mm filled therein) and stirred at a rotation frequency of 300 rpm for 60 minutes to prepare an aqueous carbon nanotube dispersion containing the zwitterionic surfactant [carbon nanotube concentration=2.96 w/w %, binder content=2.26 w/w %]. Incidentally, the pH of the aqueous dispersion was maintained at 5.3 to 6.8 during stirring using the bead mill.

(2) Adhesion Treatment of Carbon Nanotubes to Polyester Textured Yarn:

(i) A commercial available polyester POY (polyester POY30/24 manufactured by NAN YA) was 2H false-twisted in the usual manner to give a woolly textured yarn having a fineness of 24 dtex. The textured yarn was immersed in the aqueous carbon nanotube dispersion obtained in the above step (1) by a commonly used sizing manner, where the yarn was vibrated at 200 Hz through a vibrated yarn guide throughout the immersion. Then the yarn was dried at 170° C. for 2 minutes to give a polyester textured yarn having the carbon nanotubes adhered thereto and having a fineness of 28 dtex.

(ii) The adhesion amount of the carbon nanotubes to the polyester textured yarn obtained in the above step (i) was measured according to the above-mentioned method. The adhesion amount was 0.032 g per gram of the polyester textured yarn, the electric resistance value was $2.8\times10^2$ Ω/cm, and the standard deviation of the logarithm of the electric resistance value was 0.84.

Figure 2:
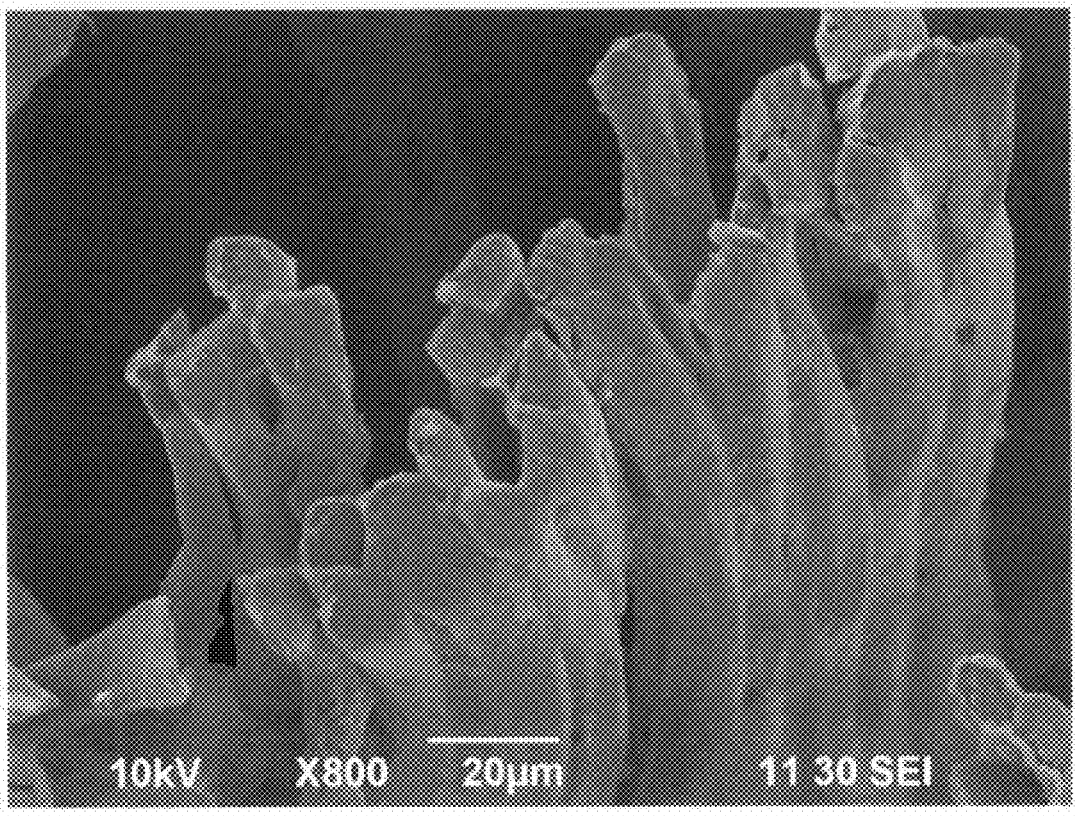
FIG. 2 represents a scanning electron microscope photograph of a cross section of electro-conductive fibers obtained in Example 2.

Further, an observation by a light microscope revealed that the substantially whole surface of the textured yarn was covered with the carbon nanotubes to be black appearance, that an area uncovered with the carbon nanotubes was not found substantially, and that the surface coverage was 100%. Moreover, after observing the cross section of the resulting textured yarn by SEM, it was found that a resin layer was formed on the surface of the textured yarn and that the layer contained the carbon nanotubes and had an almost uniform thickness of 0.3 to 2.0 μm. FIG. 2 represents a SEM photograph of the cross section of the resulting textured yarn (electro-conductive fibers). The formation of a uniform electro-conductive layer between the filaments of the multifilament is demonstrated.

(3) Production of Woven Fabric:

Further, a two ply yarn prepared from the resulting textured yarn was used as a weft and a regular polyester textured yarn (167T48) was used ad a warp to produce a taffeta cloth. Two electrodes were attached to the cloth at an interval of 5 cm along a weft direction thereof, and a 12 V direct current was applied on the cloth. As a result, the temperature of the cloth between the two electrodes rose from 20° C. (an ordinary temperature) to 36° C. after one minute. In the same way, a 40 V was applied, and the temperature of the cloth reached 140° C.

Example 3

(1) Preparation of Aqueous Carbon Nanotube Dispersion:

(i) An aqueous solution of the surfactant (pH 6.5) was prepared by mixing 2.0 g of 3-(dimethylstearylammonio) propanesulfonate (a zwitterionic surfactant), 5 ml of glycerin (a hydration stabilizer), and 495 ml of deionized water.

(ii) In a ball mill body (cylinder type, internal volume=1800 ml, ball diameter=150 mm, and filling amount of ball=3200 g), 500 ml of the aqueous solution of the surfactant obtained in the above step (i) and 10.2 g of carbon nanotubes ("MWCNT-7" manufactured by Nano Carbon Technologies Co., Ltd.) were put, and the mixture was stirred by hand to give a paste product. Then the ball mill body was placed on a rotating stand ("AS ONE" manufactured by Asahi Rika Kenkyusho, Co., Ltd.), and the paste product was stirred for one hour to give a liquid product containing the carbon nanotubes.

(iii) The whole quantity of the liquid product containing the carbon nanotubes produced in the above step (ii) was removed from the ball mill body. To the liquid product were added another 500 ml of an aqueous solution of a surfactant prepared in the same manner as in the above step (i), and further added 20.0 g of a binder ("MEIBINDER NS" manufactured by Meisei Chemical Works, Ltd., a polyester binder) in terms of solid contents. The mixture was charged in a bead mill ("DYNO-MILL" manufactured by WAB, cylindrical type, internal volume=2000 ml, 1800 g of zirconia bead having a diameter of 0.6 mm filled therein) and stirred at a rotation frequency of 300 rpm for 60 minutes to prepare an aqueous carbon nanotube dispersion containing the zwitterionic surfactant [carbon nanotube concentration=0.59 w/w %, binder content=1.51 w/w %]. Incidentally, the pH of the aqueous dispersion was maintained at 5.3 to 7.2 during stirring using the bead mill.

(2) Adhesion Treatment of Carbon Nanotubes to Polyester Textured Yarn:

(i) A polyester textured yarn ("FD84T48" manufactured by Kuraray Trading Co., Ltd.) was immersed in the aqueous carbon nanotube dispersion obtained in the above step (1) by a commonly used sizing manner, where the yarn was vibrated at 200 Hz through a vibrated yarn guide throughout the immersion. Then the yarn was dried at 170° C. for 2 minutes to give a polyester textured yarn having the carbon nanotubes adhered thereto and having a fineness of 88 dtex.

(ii) The adhesion amount of the carbon nanotubes to the polyester textured yarn obtained in the above step (i) was measured according to the above-mentioned method. The adhesion amount was 0.007 g per gram of the polyester textured yarn, the electric resistance value was $5.9\times10^9$ Ω/cm, and the standard deviation of the logarithm of the electric resistance value was 0.91.

Further, an observation by a light microscope revealed that the surface of the textured yarn was substantially covered with the carbon nanotubes to be black appearance, that an area uncovered with the carbon nanotubes was not found substantially, and that the surface coverage was 100%. Moreover, after observing the cross section of the resulting textured yarn by SEM, it was found that a resin layer was formed on the surface of the textured yarn and that the layer contained the carbon nanotubes and had an almost uniform thickness of 0.3 to 3.0 μm. Since this textured yarn has a single yarn fineness of about 2 deniers, a stable electric resistance value of $10^9$ Ω/cm, and an excellent friction durability, the textured yarn is preferably usable as a cleaning brush for copying machine.

Example 4

(1) Preparation of Aqueous Carbon Nanotube Dispersion:

In the same manner as in the step (1) of Example 2, an aqueous carbon nanotube dispersion was prepared.

(2) Adhesion Treatment of Carbon Nanotubes to Polyester Cloth:

A commercial available polyester woven fabric ("polyester" manufactured by Japanese Standards Association, taffeta, fabric weight=58 g/$m^2$) was immersed in the aqueous carbon nanotube dispersion obtained in the above step (1) with vibrating an introduction guide and a lifting guide at 300 Hz, and the dispersion was wrung from the fabric by a nip roller. The fabric was spread by a tenter, and dried at 180° C. for 2 minutes. This operation was repeated 3 times in total, and a woven fabric having the carbon nanotubes adhered thereto was obtained.

(3) The adhesion amount of the carbon nanotubes in the woven fabric obtained in the above step (2) and the thickness of the carbon nanotubes adhered to the fiber surface were measured according to the above-mentioned manner. The adhesion amount was 0.05 g per gram of the woven fabric and 2.9 g per square meter of the woven fabric.

Moreover, the surface leakage resistance value of the woven fabric obtained in the above step (2) was $1.3\times10^2$ Ω/cm before washing and $1.2\times10^3$ Ω/cm after washing 20 times (each washing was conducted in accordance with JIS L 0217, No. 103).

Further, the washing fastness of the woven fabric obtained in the above step (2) was excellent, having Grade 4-5 of change in color and Grade 5 of staining. A structure comprising this cloth and a metal-deposited cloth having an electromagnetic waves reflectivity and no electromagnetic waves absorbability in combination had an excellent electromagnetic waves absorbability, which was 25 dB at 10 GHz.

Further, an observation by a light microscope revealed that the surface of the cloth was substantially covered with the carbon nanotubes to be black appearance and that the surface coverage was 100%.

Example 5

(1) Preparation of Aqueous Carbon Nanotube Dispersion:

In the same manner as in the step (1) of Example 1, an aqueous carbon nanotube dispersion was prepared.

(2) Adhesion Treatment of Carbon Nanotubes to Vectran:

(i) Vectran HT (manufactured by Kuraray Co., Ltd., 1670T/300f) was immersed in the aqueous carbon nanotube dispersion obtained in the above step (1) by a commonly used sizing manner, where the yarn was vibrated at 200 Hz through a vibrated yarn guide throughout the immersion. Then the yarn was dried at 170° C. for 2 minutes to give a polyester textured yarn having the carbon nanotubes adhered thereto and having a fineness of 1758 dtex.

(ii) The adhesion amount of the carbon nanotubes to the polyester textured yarn obtained in the above step (i) was measured according to the above-mentioned method. The adhesion amount was 0.015 g per gram of the polyester textured yarn, the electric resistance value was $1.4\times10^4$ Ω/cm, and the standard deviation of the logarithm of the electric resistance value was 0.74.

Further, an observation by a light microscope revealed that the surface of the textured yarn was substantially covered with the carbon nanotubes to be black appearance, that an area uncovered with the carbon nanotubes was not found substantially, and that the surface coverage was 100%. Furthermore, after observing the cross section of the textured yarn by SEM, it was found that a resin layer was formed on the surface of the textured yarn and that the layer contained the carbon nanotubes and had an almost uniform thickness of 0.3 to 3.0 μm. The resulting Vectran electroconductive yarn is preferably used for a heat-resistant antistatic filter.

Comparative Example 1

A polyester textured yarn with carbon nanotubes adhered thereto was obtained in the same manner as in Example 2 except that no vibration was applied throughout the immersion of the textured yarn in the dispersion in Example 2. The electric resistance value of the resulting polyester textured yarn varied widely from $10^4$ to $10^{10}$ Ω/cm, and the standard deviation of the logarithm of the electric resistance value was 1.9. Further, an observation by a light microscope revealed that part of the inside of the textured yarn was white to gray, which was not covered with the carbon nanotubes, and that the surface coverage was 45%.

The invention claimed is:

1. An electro-conductive fiber, comprising:

at least one synthetic fiber; and an electro-conductive layer, comprising at least one carbon nanotube, a surfactant and a binder, and covering a surface of the at least one synthetic fiber, and having an electric resistance value at 20° C. ranging from $1\times10^{-2}$ to $4.9\times10^5$ Ω/cm, wherein:

the carbon nanotube comprises a multi-walled carbon nanotube, the surfactant comprises at least one member selected from the group consisting of an anionic surfactant, a cationic surfactant and a zwitterionic surfactant, the binder comprises at least one hydrophilic adhesive resin selected from the group consisting of a polyester resin, an acrylic resin, a vinyl acetate resin and a urethane resin, the covering of the electro-conductive layer relative to a whole surface of the at least one synthetic fiber is not less than 60%;

a ratio of the at least one carbon nanotube is 1 to 20 parts by mass relative to 100 parts by mass of the at least one synthetic fiber;

a ratio of the surfactant is 0.03 to 50 parts by mass relative to 100 parts by mass of the carbon nanotube; and a ratio of the binder is 50 to 400 parts by mass relative to 100 parts by mass of the carbon nanotube; and the electro-conductive layer has a thickness of from 0.1 to 5 μm.

2. The electro-conductive fiber of claim 1, wherein the covering of the electro-conductive layer relative to the whole surface of the at least one synthetic fiber is not less than 90%.

3. The electro-conductive fiber of claim 1, wherein the at least one synthetic fiber forms a yarn, and an average fineness of the yarn is 10 to 1000 dtex.

4. The electro-conductive fiber of claim 1, having an electric resistance value at 20° C. ranging from $1\times10^{-2}$ to $1\times10^{8}$ Ω/cm.

5. The electro-conductive fiber of claim 1, having a standard deviation of a logarithm of an electric resistance value of less than 1.0.

6. The electro-conductive fiber of claim 1, wherein, when two electrodes are attached to the electro-conductive fiber at an interval of 5 cm and a 12 V direct current or alternating current is applied on the electro-conductive fiber at 20° C., a temperature of the electro-conductive fiber between the two electrodes is raised by not lower than 2° C. after 60 seconds.

7. The electro-conductive fiber of claim 1, wherein the at least one synthetic fiber comprises at least one member selected from the group consisting of a polyester resin, a polyamide resin, a polyolefin resin, and an acrylic resin.

8. An electro-conductive yarn, comprising at least one of the electro-conductive fiber of claim 1.

9. The electro-conductive yarn of claim 8, which is a multifilament or a spun yarn.

10. The electro-conductive fiber of claim 1, wherein:

a ratio of the binder is 100 to 300 parts by mass relative to 100 parts by mass of the carbon nanotube.

11. The electro-conductive fiber of claim 1, wherein the carbon nanotube has an average diameter of about 5 to 300 nm.

12. The electro-conductive fiber of claim 11, wherein the multi-walled carbon nanotube has an average length of about 1 to 1000 μm.

13. The electro-conductive fiber of claim 11, which has an electric resistance value at 20° C. ranging from $1\times10^{-2}$ to $1\times10^{4}$ Ω/cm.

14. The electro-conductive fiber of claim 1, wherein the multi-walled carbon nanotubes form a network in the electro-conductive layer.

15. The electro-conductive fiber of claim 14, wherein the multi-walled carbon nanotubes are homogenously and firmly adhered to the surface of the synthetic fiber.

16. An electro-conductive fiber structural object, formed from at least one selected from the group consisting of the electro-conductive fiber of claim 1 and an electro-conductive yarn comprising at least one of the electro-conductive fiber.

17. The electro-conductive fiber structural object of claim 16, wherein a surface leakage resistance value at 20° C. ranges from $1\times10^{-2}$ to $1\times10^{10}$ Ω/cm, and the surface leakage resistance value after the fiber structural object is washed 20 times in accordance with JIS L 0217, No. 103 is 1 to 10000 times as large as the surface leakage resistance value before washing.

18. The electro-conductive fiber structural object according to claim 16, wherein, when two electrodes are attached to the electro-conductive fiber at an interval of 5 cm and a 12 V direct current or alternating current is applied on the electro-conductive fiber at 20° C., a temperature of the electro-conductive fiber between the two electrodes is raised by not lower than 2° C. after 60 seconds.

19. A process for producing the electro-conductive fiber of claim 1, the process comprising:

adhering the at least one carbon nanotube to a surface of the at least one synthetic fiber by contacting the surface with a dispersion comprising the at least one carbon nanotube, the surfactant, and the binder, to form the electro-conductive layer comprising the at least one carbon nanotube, the binder and the surfactant adhered to the surface of the at least one synthetic fiber; and drying a resulting fiber comprising the at least one synthetic fiber having the electro-conductive layer adhered to the surface thereof, to form the electro-conductive fiber.

20. The process of claim 19, wherein, in the contacting, the at least one synthetic fiber is immersed in the dispersion with vibrating the at least one synthetic fiber to adhere the at least one carbon nanotube, the binder and the surfactant to the surface of the at least one synthetic fiber and to form the electro-conductive layer.

21. The process of claim 20, wherein a frequency of vibrating is not less than 20 Hz.

22. The process of claim 19, wherein the surfactant comprises a zwitterionic surfactant.

23. The process of claim 19, wherein the binder comprises at least one selected from the group consisting of an aqueous polyester resin, an aqueous acrylic resin, a vinyl acetate resin, and a polyurethane resin.

24. The process of claim 19, wherein a ratio of the surfactant is 0.1 to 50 parts by mass relative to 100 parts by mass of the carbon nanotube.

25. An electro-conductive yarn, comprising at least one electro-conductive fiber obtained by the process of claim 19.

26. An electro-conductive fiber structural object formed from at least one selected from an electro-conductive fiber obtained by the process of claim 19 an electro-conductive yarn comprising at least one of the electro-conductive fiber.

* * * * *